US009257780B2

(12) United States Patent
Thomas et al.

(10) Patent No.: US 9,257,780 B2
(45) Date of Patent: Feb. 9, 2016

(54) COAXIAL CABLE CONNECTOR WITH WEATHER SEAL

(71) Applicant: PPC Broadband, Inc., East Syracuse, NY (US)

(72) Inventors: Charles Thomas, Athens, PA (US); Harold Watkins, Horsehead, NY (US); Mike Dean, Waverly, NY (US); Timothy N. Tremba, Cayuta, NY (US); Roger Phillips, Horsehead, NY (US); Brian Derenthal, Horsehead, NY (US); Bruce Hauver, Elmira, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

(21) Appl. No.: 13/967,967

(22) Filed: Aug. 15, 2013

(65) Prior Publication Data

US 2014/0051275 A1 Feb. 20, 2014

Related U.S. Application Data

(60) Provisional application No. 61/684,044, filed on Aug. 16, 2012.

(51) Int. Cl.

| | |
|---|---|
| ***H01R 13/622*** | (2006.01) |
| ***H01R 13/52*** | (2006.01) |
| *H01R 9/05* | (2006.01) |

(52) U.S. Cl.

CPC ..... *H01R 13/52* (2013.01); *H01R 13/5205* (2013.01); *H01R 9/0521* (2013.01)

(58) Field of Classification Search

CPC ..... H01R 13/622; H01R 13/5219; H01R 2103/00; H01R 24/40

USPC ..... 439/578, 583, 584

See application file for complete search history.

(56) References Cited

U.S. PATENT DOCUMENTS

| | | | | |
|---|---|---|---|---|
| 3,609,636 | A * | 9/1971 | Kubin et al. | 439/277 |
| 4,136,921 | A * | 1/1979 | Hardy et al. | 439/320 |
| 4,834,675 | A * | 5/1989 | Samchisen | 439/578 |
| 4,902,246 | A * | 2/1990 | Samchisen | 439/578 |
| 5,393,244 | A | 2/1995 | Szegda | |
| 5,444,810 | A | 8/1995 | Szegda | |
| 5,470,257 | A | 11/1995 | Szegda | |
| 5,632,651 | A | 5/1997 | Szegda | |
| 6,089,912 | A * | 7/2000 | Tallis et al. | 439/584 |
| 6,153,830 | A | 11/2000 | Montena | |
| 6,558,194 | B2 | 5/2003 | Montena | |
| 6,676,446 | B2 | 1/2004 | Montena | |
| 6,716,062 | B1 | 4/2004 | Palinkas et al. | |
| 6,722,922 | B2 * | 4/2004 | Cykon et al. | 439/587 |
| 6,848,940 | B2 | 2/2005 | Montena | |
| 6,884,113 | B1 | 4/2005 | Montena | |
| 6,971,912 | B2 | 12/2005 | Montena et al. | |

(Continued)

FOREIGN PATENT DOCUMENTS

| | | | |
|---|---|---|---|
| EP | 0518597 | A2 | 12/1992 |
| WO | WO/96/08854 | A1 | 3/1996 |

(Continued)

*Primary Examiner* — Gary Paumen

(74) *Attorney, Agent, or Firm* — Barclay Damon, LLP

(57) ABSTRACT

A connector is attachable to a coaxial cable. The connector, in one embodiment, has a connector body, a sleeve, a fastener and a seal assembly. At least part of the seal assembly is configured to be removeably coupled to the sleeve.

32 Claims, 23 Drawing Sheets

(56) References Cited

U.S. PATENT DOCUMENTS

| | | | | |
|---|---|---|---|---|
| 6,994,588 | B2 | 2/2006 | Montena | |
| 7,004,788 | B2 | 2/2006 | Montena | |
| 7,014,501 | B2 | 3/2006 | Montena | |
| 7,029,304 | B2 | 4/2006 | Montena | |
| 7,097,500 | B2 | 8/2006 | Montena | |
| 7,128,605 | B2 | 10/2006 | Montena | |
| 7,153,160 | B2 | 12/2006 | Montena | |
| 7,156,696 | B1 | 1/2007 | Montena | |
| 7,161,785 | B2 | 1/2007 | Chawgo | |
| 7,163,420 | B2 | 1/2007 | Montena | |
| 7,214,095 | B1 | 5/2007 | Mathews | |
| 7,217,155 | B2 | 5/2007 | Montena | |
| 7,297,023 | B2 | 11/2007 | Chawgo | |
| 7,299,550 | B2 | 11/2007 | Montena | |
| 7,347,728 | B2 | 3/2008 | Montena | |
| 7,354,309 | B2 | 4/2008 | Palinkas | |
| 7,357,672 | B2 | 4/2008 | Montena | |
| 7,404,738 | B2 | 7/2008 | Montena | |
| 7,524,208 | B2 | 4/2009 | Mathews | |
| 7,632,141 | B2 * | 12/2009 | Malak | 439/578 |
| 7,727,011 | B2 | 6/2010 | Montena et al. | |
| 7,798,849 | B2 | 9/2010 | Montena | |
| 7,828,595 | B2 | 11/2010 | Mathews | |
| 7,833,053 | B2 | 11/2010 | Mathews | |
| 7,845,976 | B2 | 12/2010 | Mathews | |
| 7,874,871 | B2 | 1/2011 | Montena | |
| 7,892,005 | B2 | 2/2011 | Haube | |
| 7,931,498 | B2 | 4/2011 | Skeels et al. | |
| 7,934,954 | B1 | 5/2011 | Chawgo et al. | |
| 7,942,694 | B2 | 5/2011 | Amidon | |
| 7,950,958 | B2 | 5/2011 | Mathews | |
| 7,993,159 | B2 | 8/2011 | Chawgo | |
| 7,997,930 | B2 | 8/2011 | Ehret et al. | |
| 8,007,314 | B2 | 8/2011 | Chawgo et al. | |
| 8,029,315 | B2 | 10/2011 | Purdy et al. | |
| 8,038,471 | B2 | 10/2011 | Malak | |
| 8,038,472 | B2 | 10/2011 | Montena et al. | |
| 8,038,473 | B2 | 10/2011 | Amidon | |
| 8,075,338 | B1 | 12/2011 | Montena | |
| 8,079,860 | B1 | 12/2011 | Zraik | |
| 8,113,879 | B1 | 2/2012 | Zraik | |
| 8,123,557 | B2 | 2/2012 | Montena et al. | |
| 8,152,537 | B1 | 4/2012 | Montena | |
| 8,152,551 | B2 | 4/2012 | Zraik | |
| 8,152,559 | B1 | 4/2012 | Montena | |
| 8,157,589 | B2 | 4/2012 | Krenceski et al. | |
| 8,167,635 | B1 | 5/2012 | Mathews | |
| 8,167,636 | B1 | 5/2012 | Montena | |
| 8,167,646 | B1 | 5/2012 | Mathews | |
| 8,177,582 | B2 | 5/2012 | Amidon | |
| 8,177,583 | B2 | 5/2012 | Chawgo et al. | |
| 8,192,237 | B2 | 6/2012 | Purdy et al. | |
| 2002/0030329 | A1 | 3/2002 | Montena | |
| 2003/0025283 | A2 | 2/2003 | Montena | |
| 2003/0068924 | A1 | 4/2003 | Montena | |
| 2003/0114045 | A1 | 6/2003 | Montena | |
| 2005/0020128 | A1 | 1/2005 | Montena | |
| 2005/0042919 | A1 | 2/2005 | Montena | |
| 2005/0148236 | A1 | 7/2005 | Montena | |
| 2005/0170692 | A1 | 8/2005 | Montena | |
| 2005/0176296 | A1 | 8/2005 | Montena | |
| 2006/0009074 | A1 | 1/2006 | Montena | |
| 2006/0073726 | A1 | 4/2006 | Montena | |
| 2006/0160417 | A1 | 7/2006 | Montena | |
| 2006/0194474 | A1 | 8/2006 | Montena | |
| 2006/0199428 | A1 | 9/2006 | Montena | |
| 2007/0099489 | A1 | 5/2007 | Montena | |
| 2007/0123101 | A1 | 5/2007 | Palinkas | |
| 2008/0014790 | A1 | 1/2008 | Montena | |
| 2008/0207033 | A1 | 8/2008 | Malak | |
| 2008/0274643 | A1 | 11/2008 | Chawgo | |
| 2009/0233482 | A1 | 9/2009 | Chawgo et al. | |
| 2009/0265745 | A1 | 10/2009 | Egan, Jr. et al. | |
| 2010/0055978 | A1 | 3/2010 | Montena | |
| 2010/0203760 | A1 | 8/2010 | Montena | |
| 2010/0255721 | A1 | 10/2010 | Purdy et al. | |
| 2010/0261381 | A1 | 10/2010 | Montena et al. | |
| 2011/0003498 | A1 | 1/2011 | Amidon | |
| 2011/0143586 | A1 | 6/2011 | Ehret et al. | |
| 2011/0207355 | A1 | 8/2011 | Amidon | |
| 2011/0239451 | A1 | 10/2011 | Montena et al. | |
| 2011/0244722 | A1 | 10/2011 | Chawgo et al. | |
| 2011/0263154 | A1 | 10/2011 | Chawgo et al. | |
| 2012/0003869 | A1 | 1/2012 | Ehret et al. | |
| 2012/0088405 | A1 | 4/2012 | Wild et al. | |
| 2012/0088407 | A1 | 4/2012 | Natoli | |
| 2012/0094530 | A1 | 4/2012 | Montena | |
| 2012/0094532 | A1 | 4/2012 | Montena | |

FOREIGN PATENT DOCUMENTS

| | | | |
|---|---|---|---|
| WO | WO/2004/095641 | A2 | 11/2004 |
| WO | WO/2005/041359 | A1 | 5/2005 |
| WO | WO/2006/078452 | A1 | 7/2006 |
| WO | WO/2008/137336 | A1 | 11/2008 |
| WO | WO/2009/045935 | A2 | 4/2009 |
| WO | WO/2009/045935 | A3 | 4/2009 |
| WO | WO/2010/114974 | A2 | 10/2010 |
| WO | WO/2011/071787 | A2 | 6/2011 |
| WO | WO/2011/123828 | A2 | 10/2011 |
| WO | WO/2012/048260 | A1 | 4/2012 |
| WO | WO/2012/048260 | A9 | 4/2012 |

* cited by examiner

COAXIAL CABLE CONNECTOR WITH WEATHER SEAL

PRIORITY CLAIM

This application claims the benefit and priority of U.S. Provisional Patent Application Ser. No. 61/684,044, filed on Aug. 16, 2012. The entire contents of such applications are hereby incorporated by reference

BACKGROUND

The present disclosure relates generally to the field of coaxial connectors, and more specifically, to coaxial cable connectors that may include a weather seal intended to prevent moisture from migrating into the interface area between the coaxial cable connector and a mating connector.

SUMMARY

One embodiment relates to a coaxial cable connector comprising a connector body having a forward end and a rearward end, the rearward end configured to receive a coaxial cable; a sleeve configured to be received at least partially within the connector body; a fastener coupled to the forward end of the body and configured to fasten to a mating connector; and a seal assembly, at least a portion of the seal assembly removeably coupled to the sleeve.

Another embodiment relates to a coaxial cable connector comprising a connector body having a forward end and a rearward end, the rearward end configured to receive a coaxial cable; a sleeve configured to be received at least partially within the connector body; a fastener coupled to the forward end of the body and configured to fasten to a mating connector; a post disposed at least partially within the connector body; an annular seal disposed within the fastener and configured to engage a mating connector; and a compressible member disposed at least partially between the body and the nut and configured to provide a biasing force acting between the body and the nut.

DETAILED DESCRIPTION

Figure 1:
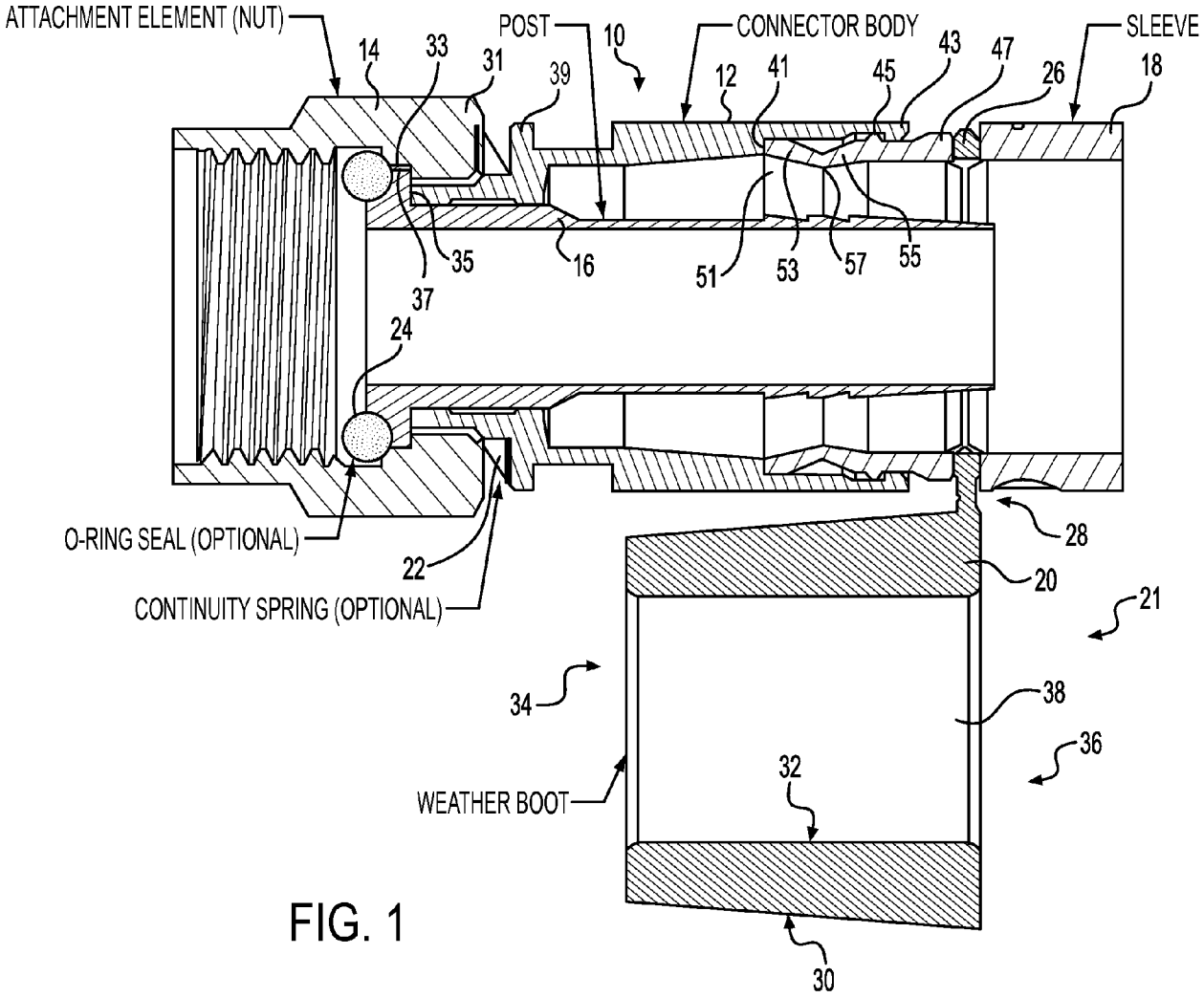
FIG. 1 is a cross-sectional view of a coaxial cable connector according to an exemplary embodiment.
Figure 3:
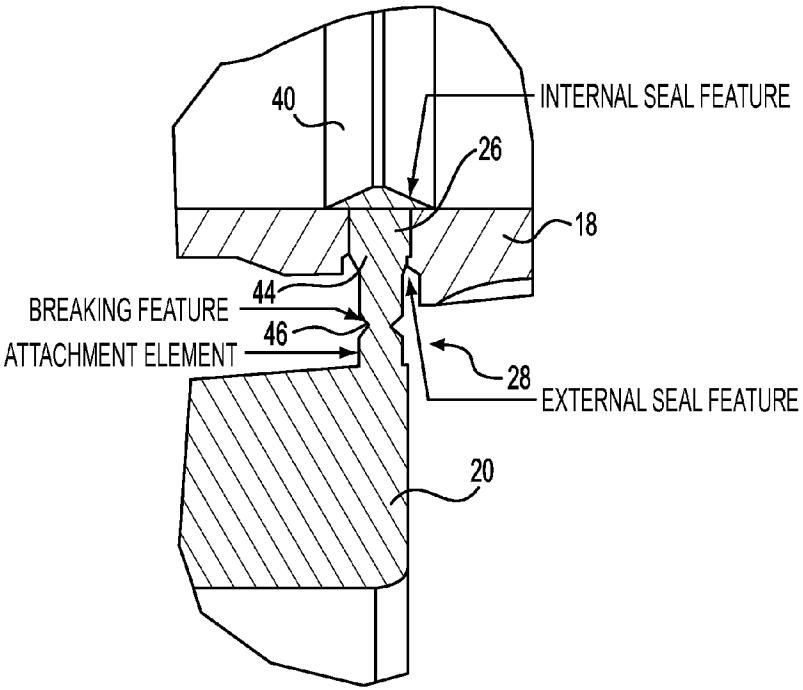
FIGS. 2-6 show various portions of the coaxial cable connector of FIG. 1 according to various embodiments.
Figure 2:
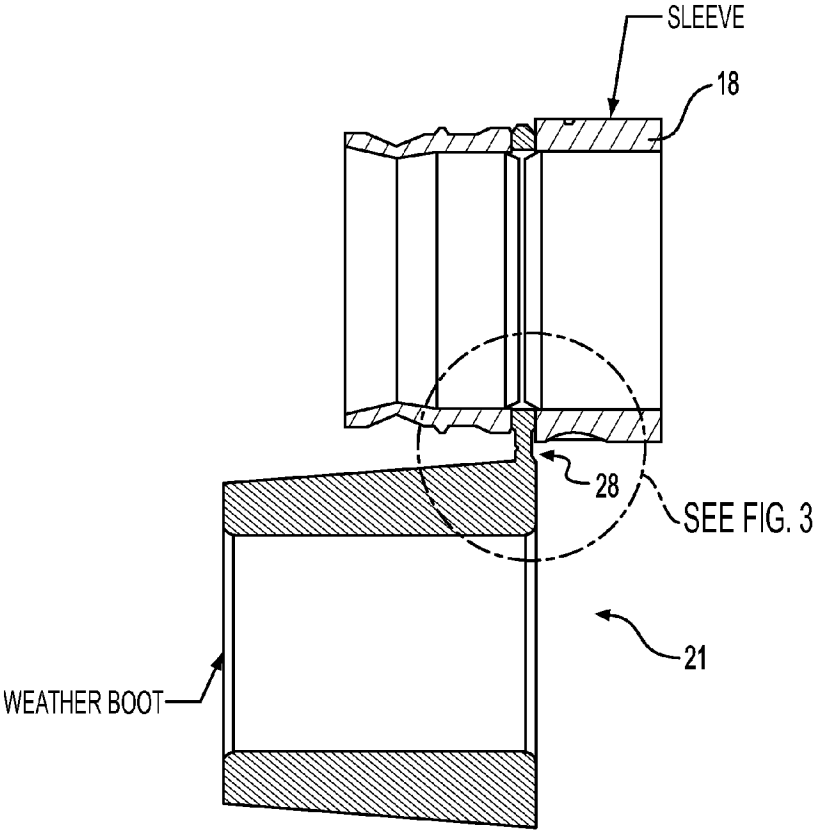

Referring to the FIGURES generally, coaxial cable connectors typically include a connector body (e.g., an annular collar, etc.) for accommodating a coaxial cable. An annular fastener such as a nut may be rotatably connected to the body for providing mechanical attachment of the connector to an external device (e.g., a mating connector or device, etc.). An annular post may be coupled to the body. The nut may include a threaded portion or other attachment feature that enables attachment of the connector to a mating connector or other device. The body includes a rearward portion configured to receive the coaxial cable. The connector may further include a locking sleeve or other component intended to facilitate retention of the cable within the connector. One or more seals (e.g., thread protectors, weather boots, environmental seals, etc.) may be provided to prevent moisture, debris, and/or other undesirable materials from entering the interior portion of the cable connector.

Referring now to FIGS. 1-6, a coaxial cable connector 10 is shown according to an exemplary embodiment. Connector 10 is configured to be assembled onto a coaxial cable, and includes a connector body 12 (e.g., a collar, body portion, etc.), a fastener 14 (e.g., a threaded nut, a coupler, etc.), and a sleeve 18 (e.g., a locking sleeve, a collapsible and/or compressible member, etc.). Connector 10 further includes a post 16 provided within one or more of body 12, fastener 14, and sleeve 18. Connector 10 may include one or more sealing members, such as o-rings 24 (e.g., elastomeric o-rings, conductive o-rings, etc.), for preventing moisture or other undesirable materials from entering the interior of connector 10 and/or for ensuring electrical continuity between connector/cable components.

According to an exemplary embodiment, connector 10 includes a seal assembly 21. Seal assembly 21 includes a sleeve seal 26 coupled to an interface seal 20 via a coupling portion or member 28. Seal assembly 21 is configured to provide a seal to one or more portions of connector 10, including sealing various portions of sleeve 18 relative other connector components, and sealing connector 10 relative to mating devices or connectors.

Figure 23:
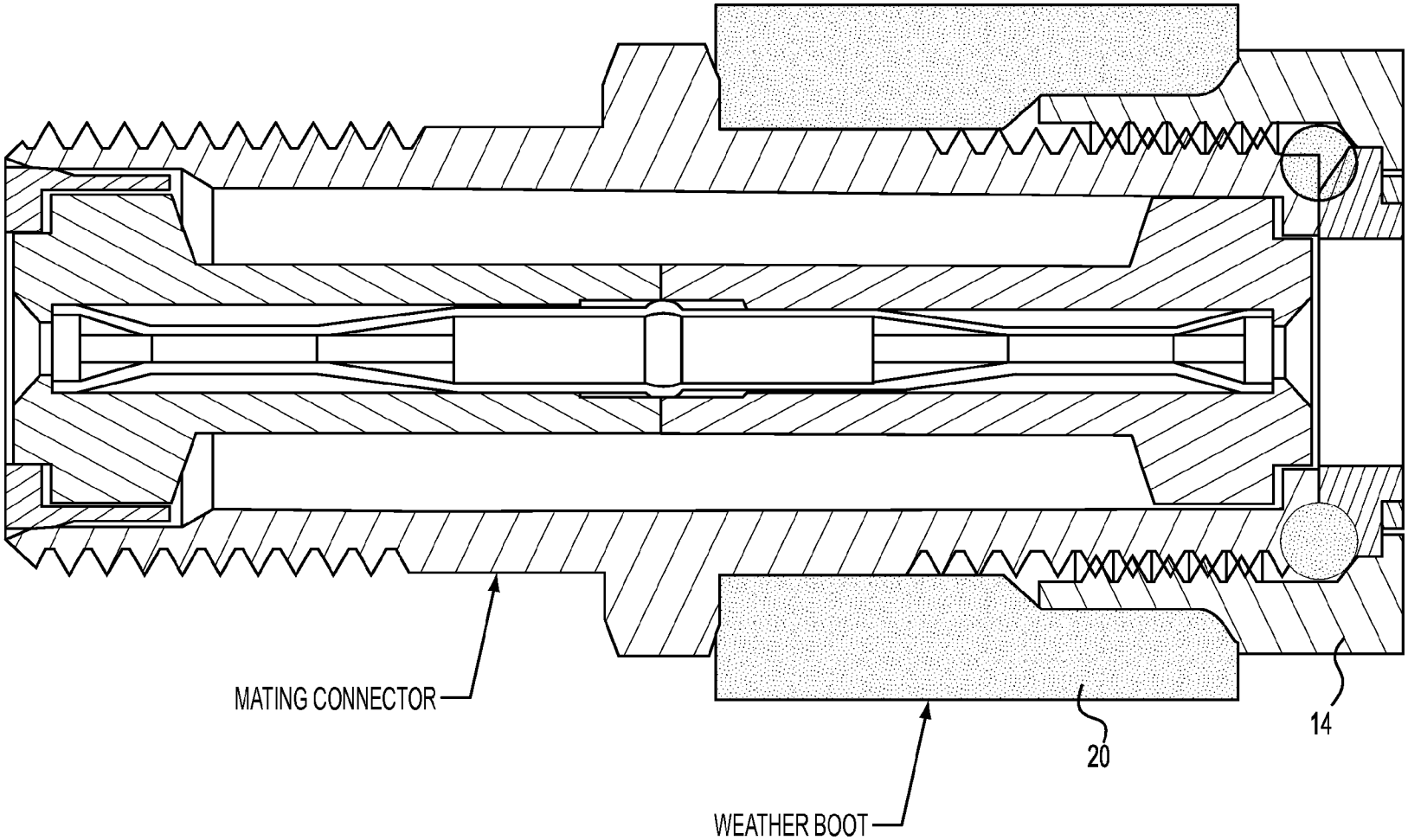
FIGS. 23-24 illustrate portions of coaxial connectors having various seals provided therewith according to exemplary embodiments.

According to an exemplary embodiment, seal assembly 21 is configured such that a user may detach interface seal 20 from sleeve seal 26 at coupling member 28. In some embodiments, coupling member 28 includes a weakened portion 46 (see FIG. 3) that is configured to rupture, tear, etc., upon a user applying a force (e.g., a linear pulling action, a twisting action, etc.) to interface seal 20 relative to sleeve seal 26. Upon separating interface seal 20, a user may then place interface seal 20 over a mating port connector, and subsequently mate connector 10 to the port connector (see, e.g., FIG. 23). Interface seal 20 is configured to create seals with both the interface port and connector 10, thereby providing an environmental seal (e.g., a thread protector, a weather boot, a moisture seal, etc.) for the interface connection to prevent moisture, debris, and/or other undesirable materials from entering the interior of connector 10 or other components.

According to an exemplary embodiment, interface seal 20 includes an outer surface 30 and an inner surface 32 that extend between a forward end 34 and a rearward end 36. One or both of inner and outer surfaces 30, 32 may be smooth, textured, or have any suitable surface contours, etc., such as knurling, etc. A bore, or aperture, 28 extends from forward end 34 to rearward end 36 and enables coupling of fastener 14 to a mating port device. As shown in FIGS. 1-6, interface seal 20 may have chamfers on one or both of the forward and rear ends to facilitate installation of interface seal 20. Furthermore, the inner diameter of interface seal 20 is shown as being substantially constant along the length of the seal. In other embodiments, the inner diameter of interface seal 20 may vary along the length of the seal. For example, the inner diameter of interface seal 20 may increase or decrease from the forward end toward the rearward end, or the inner diameter may decrease from both ends toward an intermediate portion of the seal having a minimum inner diameter. Further yet, the inner diameter may vary along the length of the seal in any desired manner to provide varying steps, tapers, variations in seal thickness, etc.

The outer diameter of interface seal 20 may likewise be constant along the length of the seal, decrease/increase from one end to the other, decrease from both ends toward an intermediate portion of the seal, or vary along the length of the seal in any desired manner.

According to one embodiment, interface seal 20 has a thickness that decreases from forward end 34 to rearward end 36. In other embodiments, the thickness of seal 20 increases from forward end 34 to rearward end 36. In yet further embodiments, the thickness of seal 20 may vary along the length of the seal to provide any desirable thickness variations. According to one embodiment, inner surface 32 defines a generally cylindrical inner surface of the seal, and outer surface 30 defines a generally frusto-conical surface for the seal (see, e.g., FIG. 1). According to other embodiments, inner and/or outer surfaces 30, 32 may take other forms. For example, outer surface 30 may have multiple generally planar surfaces (e.g., be 3, 4, 5, or 6-sided, etc.) rather than frusto-conical.

Figure 4:
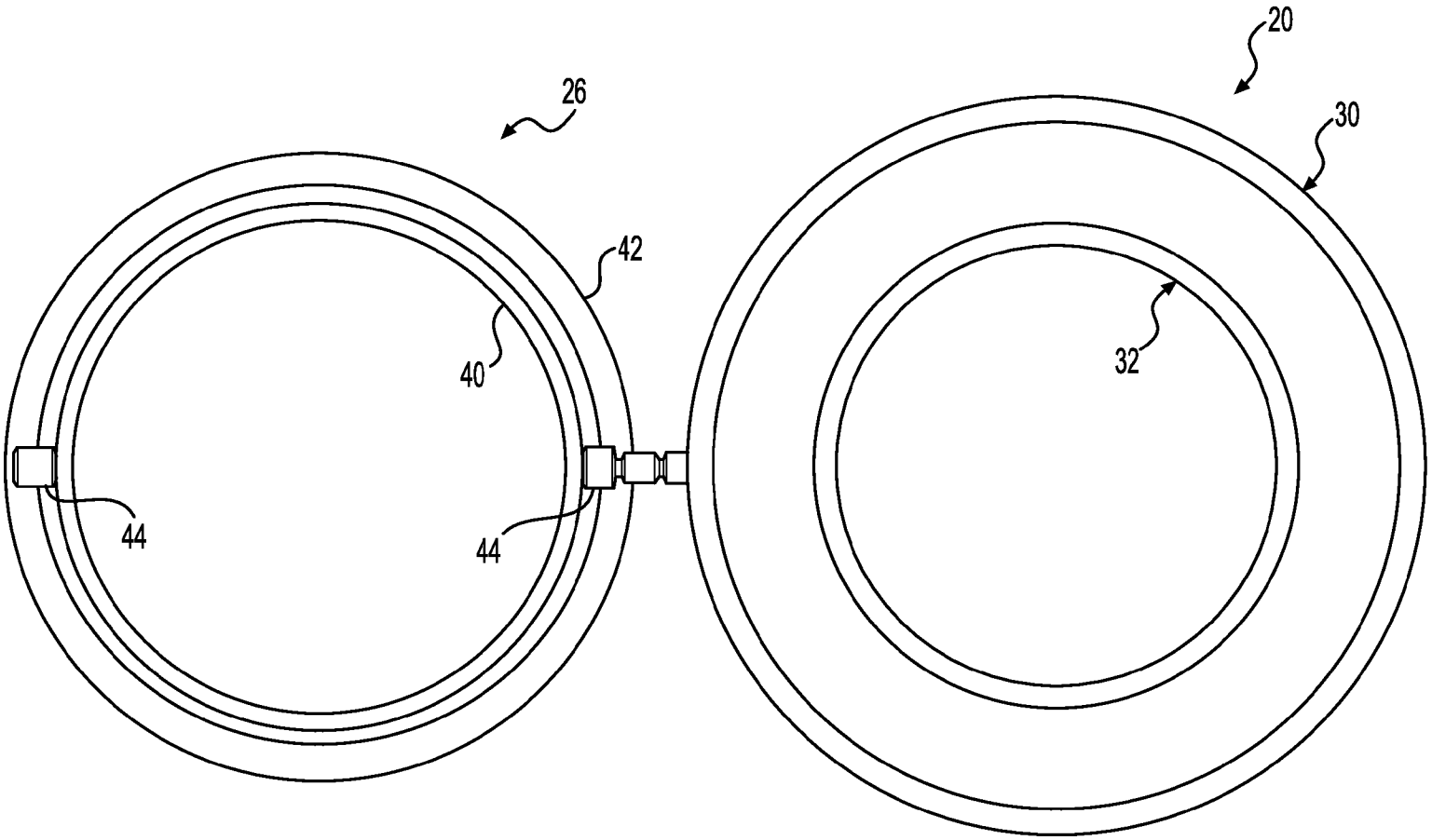
Figure 5:
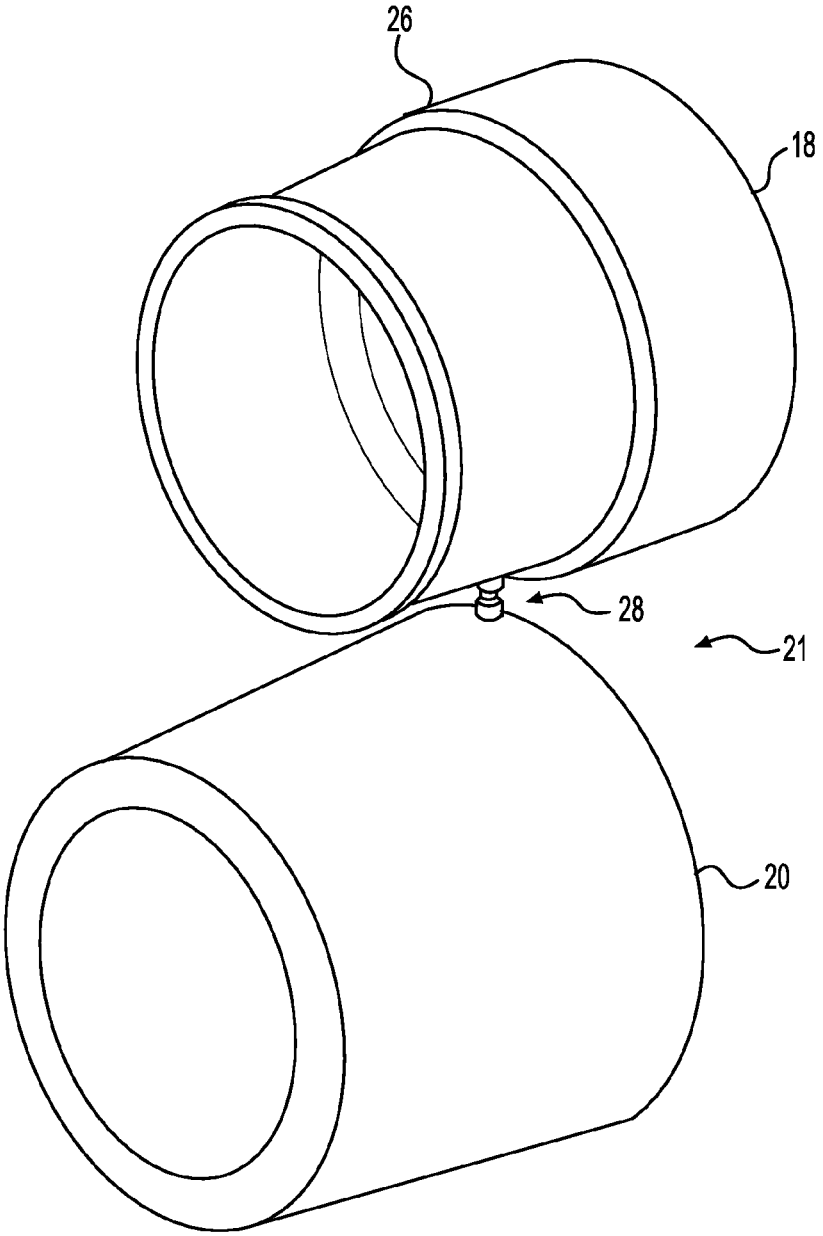
Figure 6:
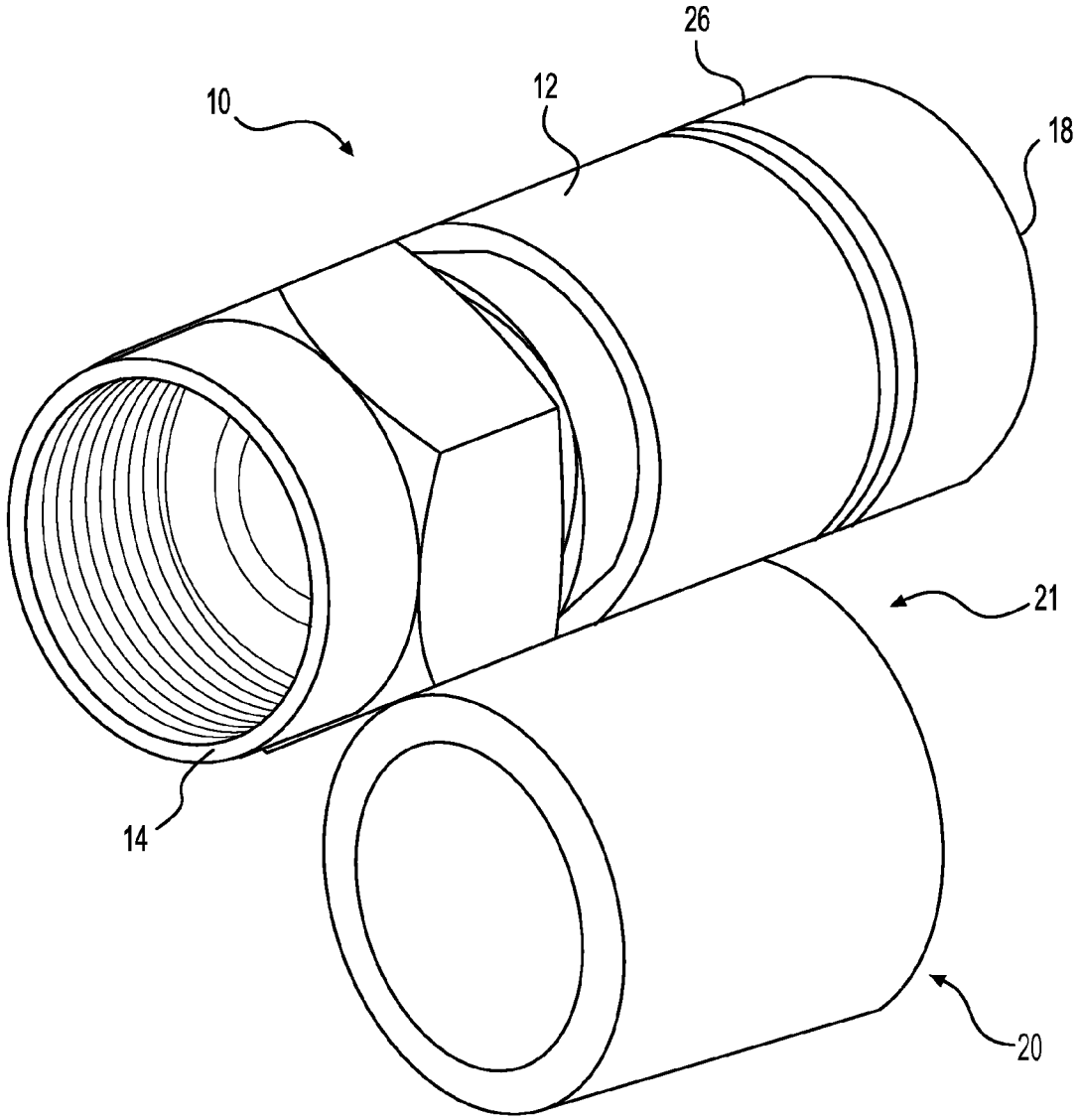

According to an exemplary embodiment, sleeve seal 26 includes an inner seal 40 coupled to an outer seal 42 by way of one or more connecting portions 44 (see FIG. 4). Inner and outer seals 40, 42 are generally annular seals that are concentric and are joined together by radially extending connecting portions 44. As shown in FIG. 4, two connecting portions 44 may be utilized. According to various alternative embodiments, more or fewer connecting portions may be utilized, and the location and/or spacing of connecting portions 44 may be varied to suit a particular application. Connecting portions 44 may take any suitable cross-sectional shape (e.g., square, rectangular, oval, circular, irregular, etc.).

According to an exemplary embodiment, sleeve seal 26 is over-molded onto sleeve 18 in a predetermined location such that connecting portions 44 extend through apertures or recesses formed in sleeve 18 to enable inner and outer sleeves 40, 42 to be formed on the inner and outer surfaces of sleeve 18. According to various alternative embodiments, sleeve seal 26 may be formed in a variety of different ways.

Figure 24:
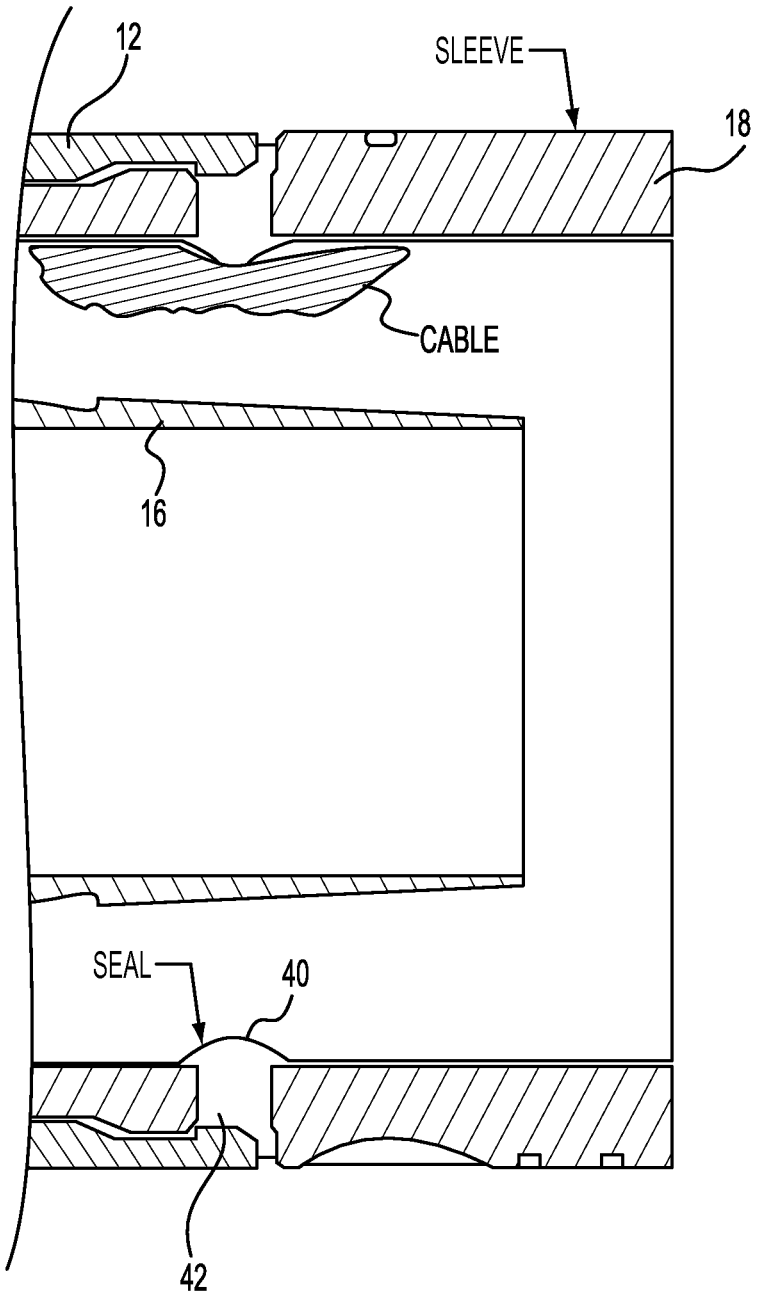

Sleeve seal 26, and more specifically inner and outer seals 40, 42, provide various sealing functions for connector 10. In one embodiment, inner seal 40 provides a seal between the coaxial cable and sleeve 18, and outer seal 42 provides a seal between connector body 12 and sleeve 18 (see, e.g., FIG. 24). In this way inner and outer sleeves 40, 42 act to prevent ingress of moisture, debris, and/or other undesirable materials into connector 10 by way of the rearward portion of the connector.

Seal assembly 21 may be made of any suitable material, including a variety of compressible polymer materials such as elastomeric materials, rubbers, etc. that provide the desired sealing characteristics for connector 10. According to one embodiment, interface seal 20 and sleeve seal 26 are made of the same material, while according to various alternative embodiments, interface seal 20 and sleeve seal 26 may be made of different materials.

In terminating connector 10, a user removes interface seal 20 from sleeve seal 26 (e.g., via coupling portion 28) by a twisting or pulling action, etc. The interface seal 20 is then placed over a port connector. Connector 10 may be terminated onto a coaxial cable by moving sleeve 18 longitudinally within connector body 12 (either before or after removing interface seal 20). Terminating connector 10 forms seals between sleeve 18 and connector body 12 (by way of outer seal 42) and between sleeve 18 and the coaxial cable (by way of inner seal 40). Connector 10 may then be mated to the port connector (e.g., by threadingly engaging a nut on the connector to the interface port, etc.) such that interface seal 20 is compressed and forms a seal with both the mating port and connector 10.

Figure 7:
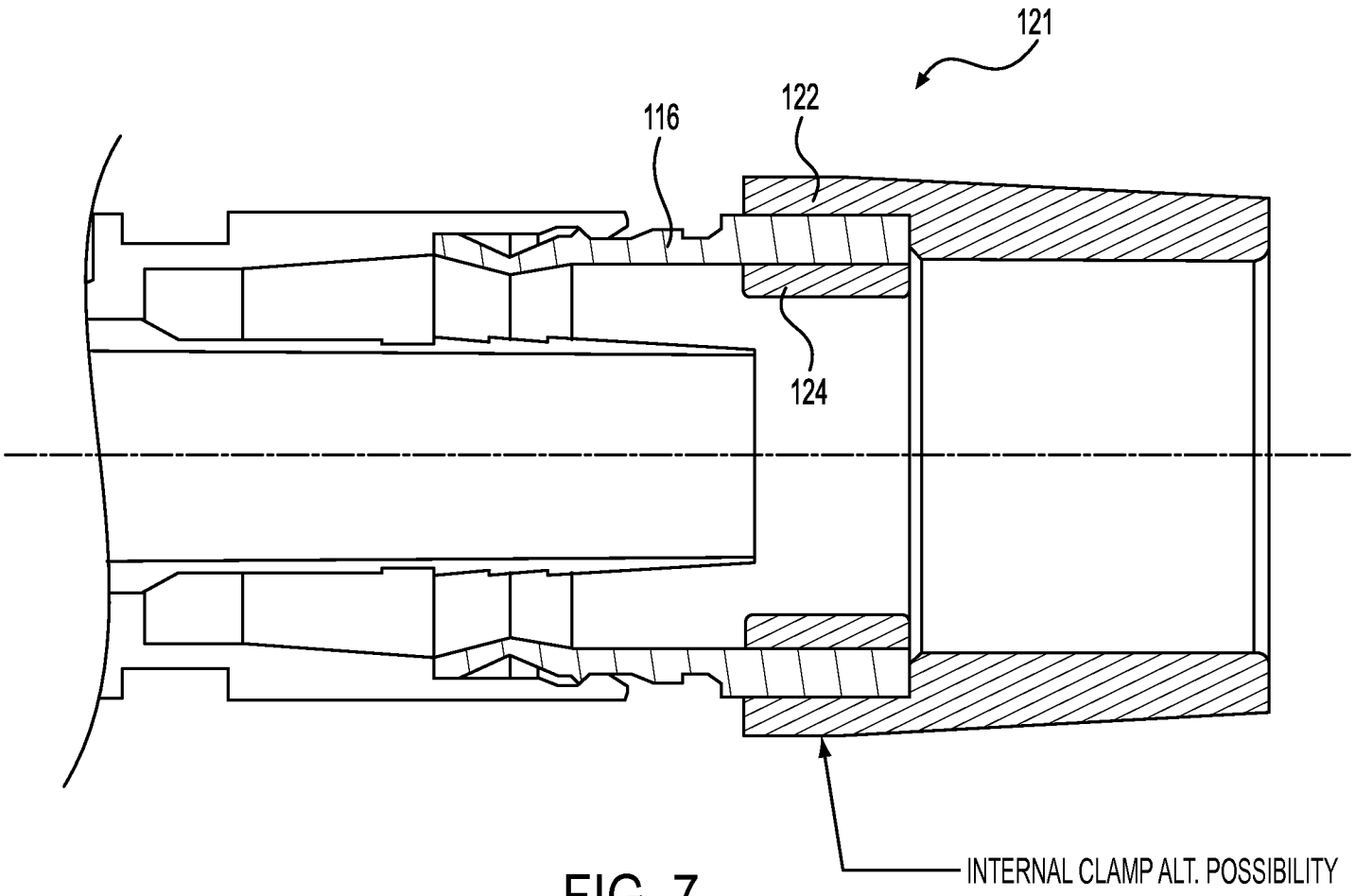
FIG. 7 is a partial cross-sectional view of a coaxial cable connector according to an exemplary embodiment.
Figure 8:
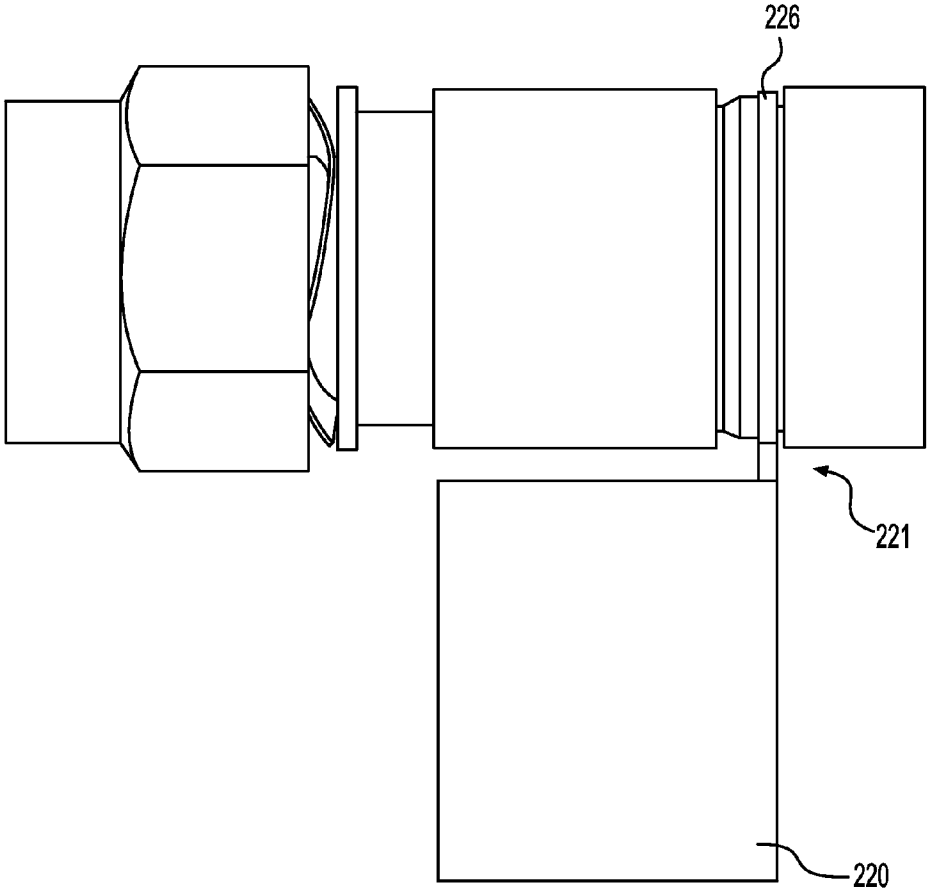
FIGS. 8-17 illustrate various coaxial cable connector and coaxial cable connector components according to various embodiments.
Figure 9:
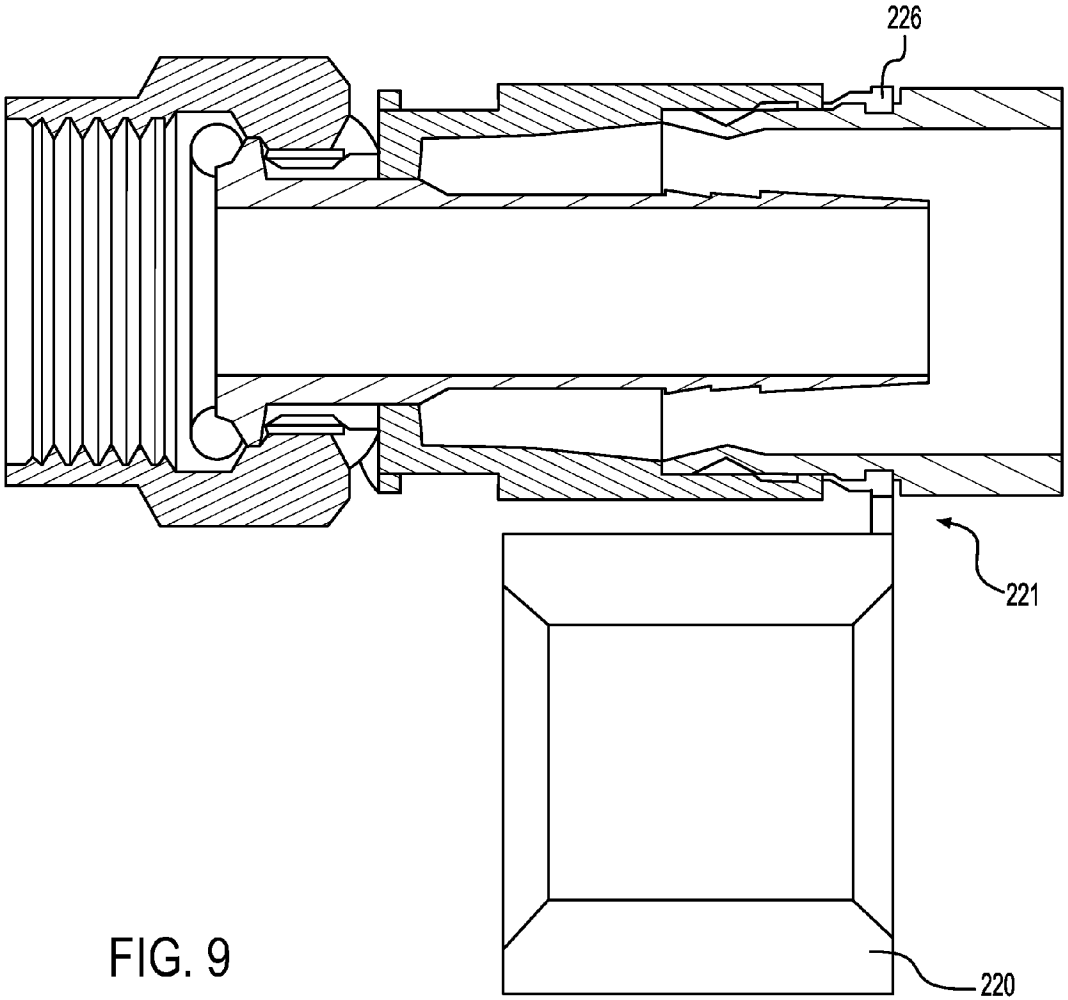

Referring to FIG. 7, a seal assembly 121 is shown according to an exemplary embodiment. As shown in FIG. 7, seal assembly 121 may share many features with seal assembly 21, except that seal assembly 121 is configured to be coupled to a rearward end of sleeve 18 in a sliding fashion. For example, seal assembly 121 may include outer extending portion 122 and/or inner extending portions 124. Portions 122 and 124 are generally annular in shape and are configured to be slid relative to sleeve 18 and form a "clamp" to retain seal assembly 121 on the rearward end of sleeve 18 until use. For example, portion 122 may have an inner diameter that is slightly undersized relative to the outer diameter of sleeve 18, such that outer portion 122 must be expanded, etc. when seal assembly 121 is slid onto sleeve 18. Similarly, inner portion 124 may have an outer diameter that is slightly oversized relative to the inner diameter of sleeve 18, such that inner portion 124 must be compressed when seal assembly 121 is slid onto sleeve 18. One or both of inner and outer portions 122, 124 may be used according to various alternative embodiments.

Figure 20:
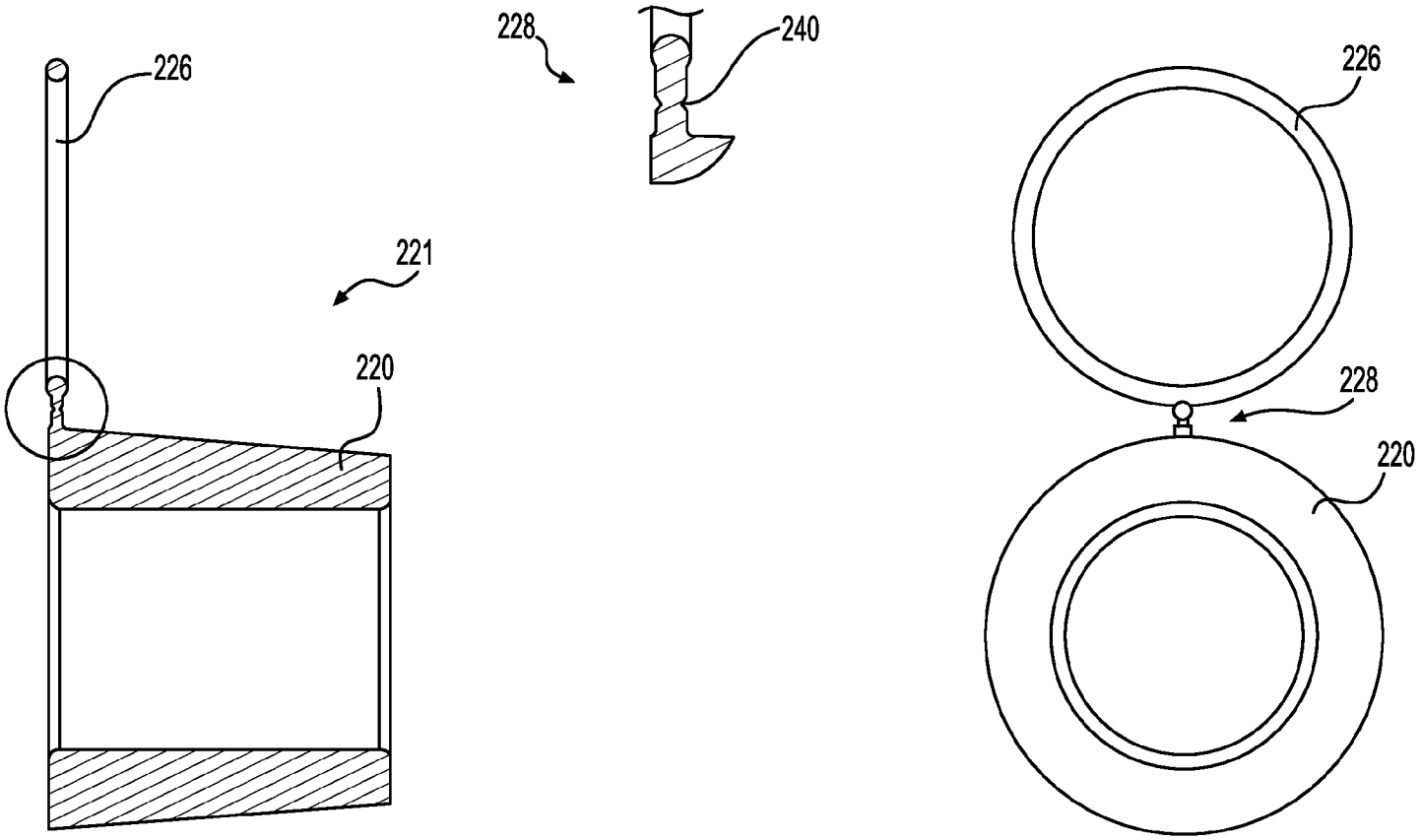
Figure 21:
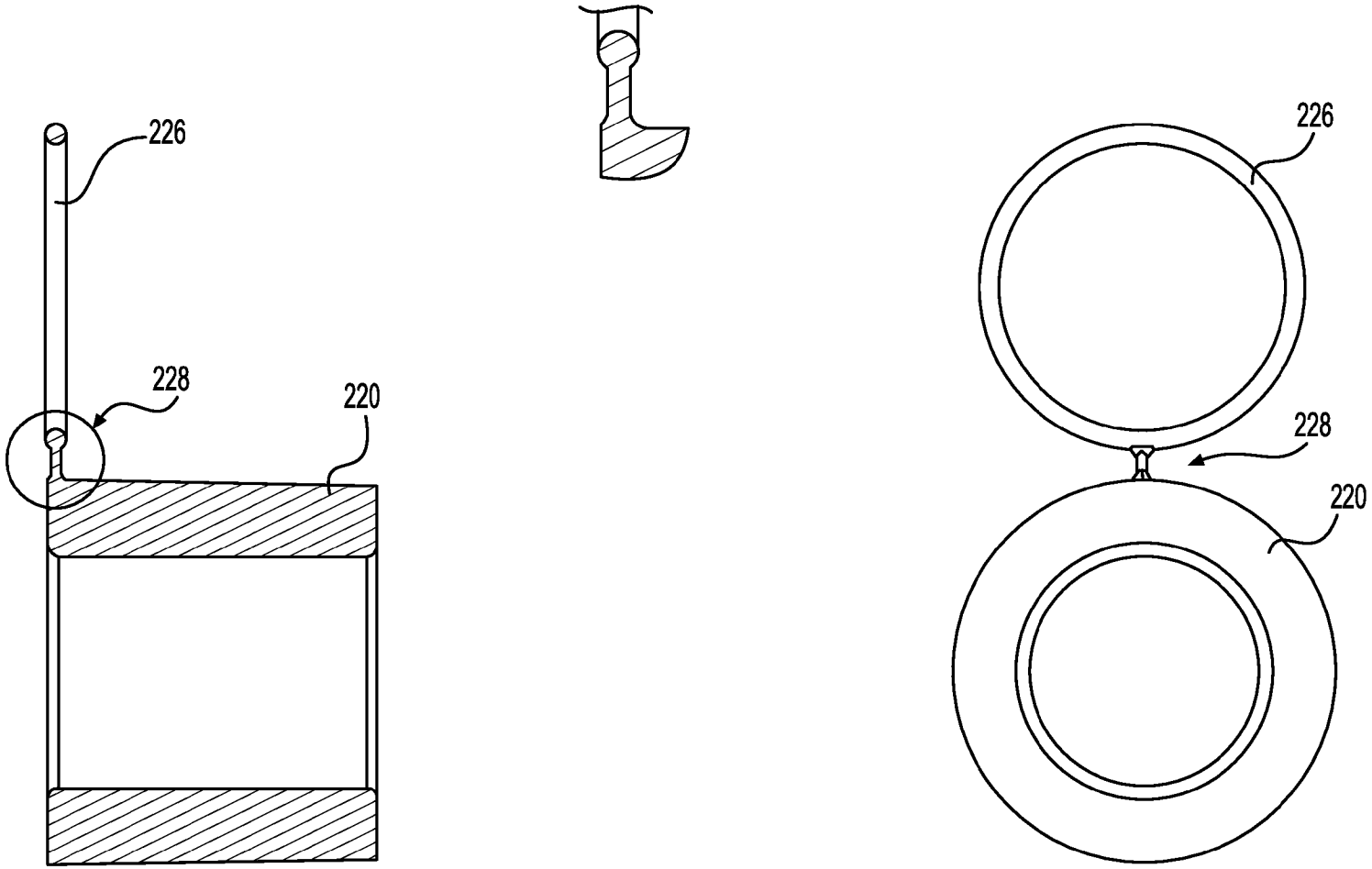

Referring to FIGS. 8-9 and 20-21, a seal assembly 221 is shown according to an exemplary embodiment coupled to connector 10. Seal assembly 221 includes an interface seal 220 and an attachment ring 226 that extends in an annular fashion around a portion of sleeve 18. In one embodiment, attachment ring 226 also forms a seal between sleeve 18 and connector body 12 when connector 10 is terminated. In some embodiments, interface seal 220 has generally cylindrical inner and outer surfaces, and chamfers may be provided at one or both ends of the inner surface (see, e.g., FIG. 21). Like interface seal 20, in other embodiments, the inner and outer surfaces may take other dimensions according to other alternative embodiments. For example, as shown in FIG. 20, the exterior of interface seal 220 may be frusto-conical in shape, while the inner surface may define a generally constant inner diameter with chamfers at one or both ends. A connecting portion 228 having a weakened area 240 may connect interface seal to attachment ring 226 and enable detachment of interface seal 220.

Figure 12:
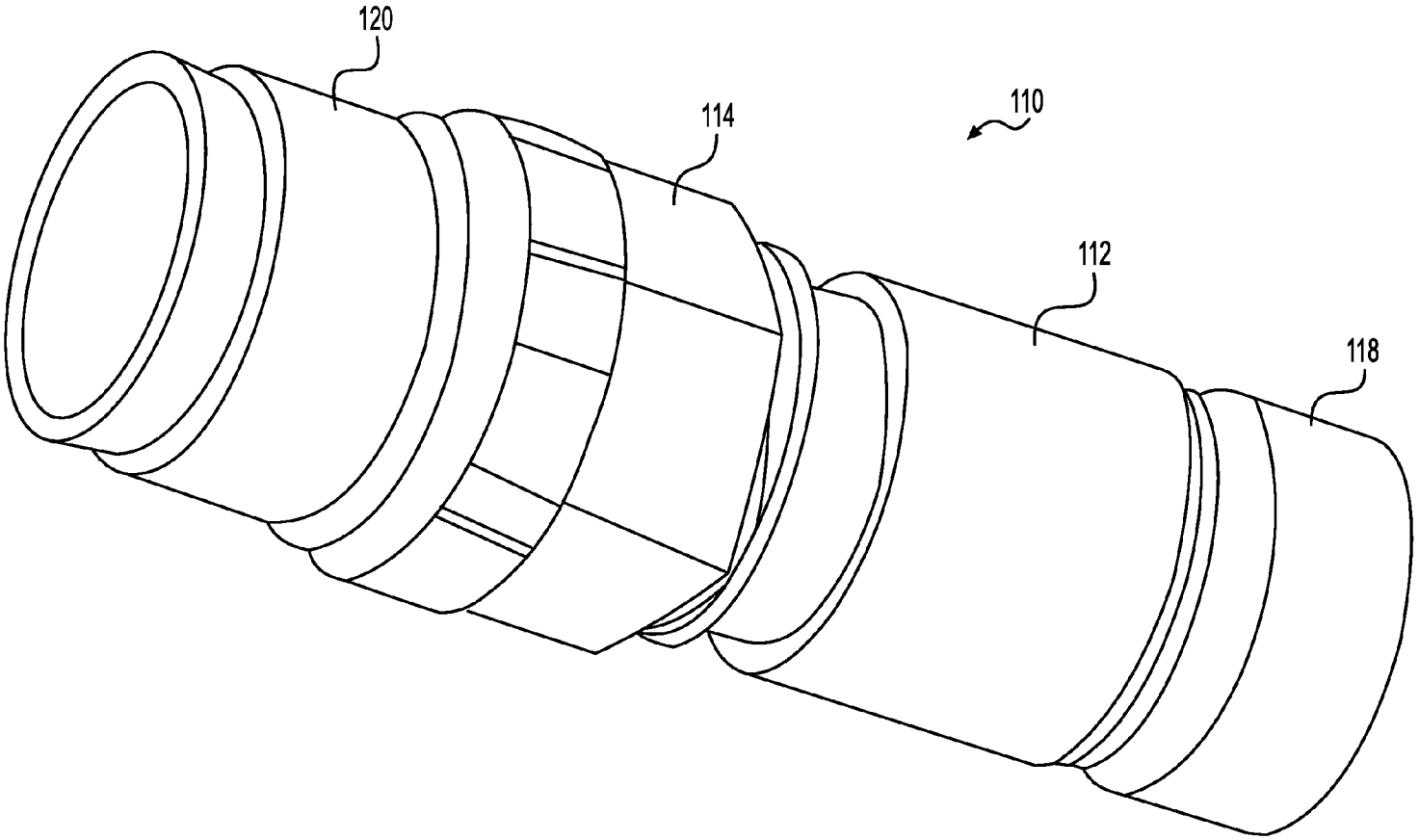
Figure 13:
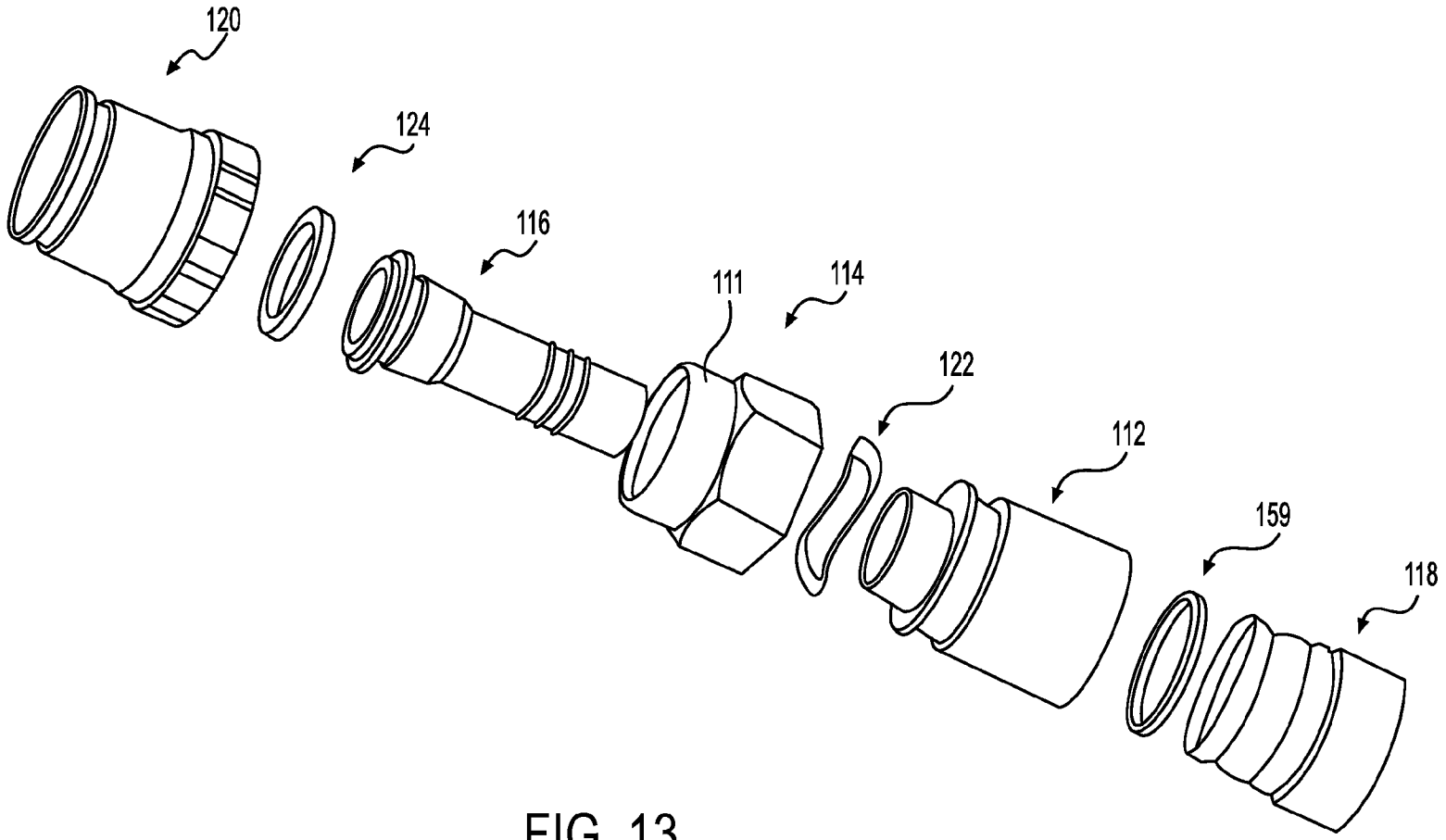
Figure 14:
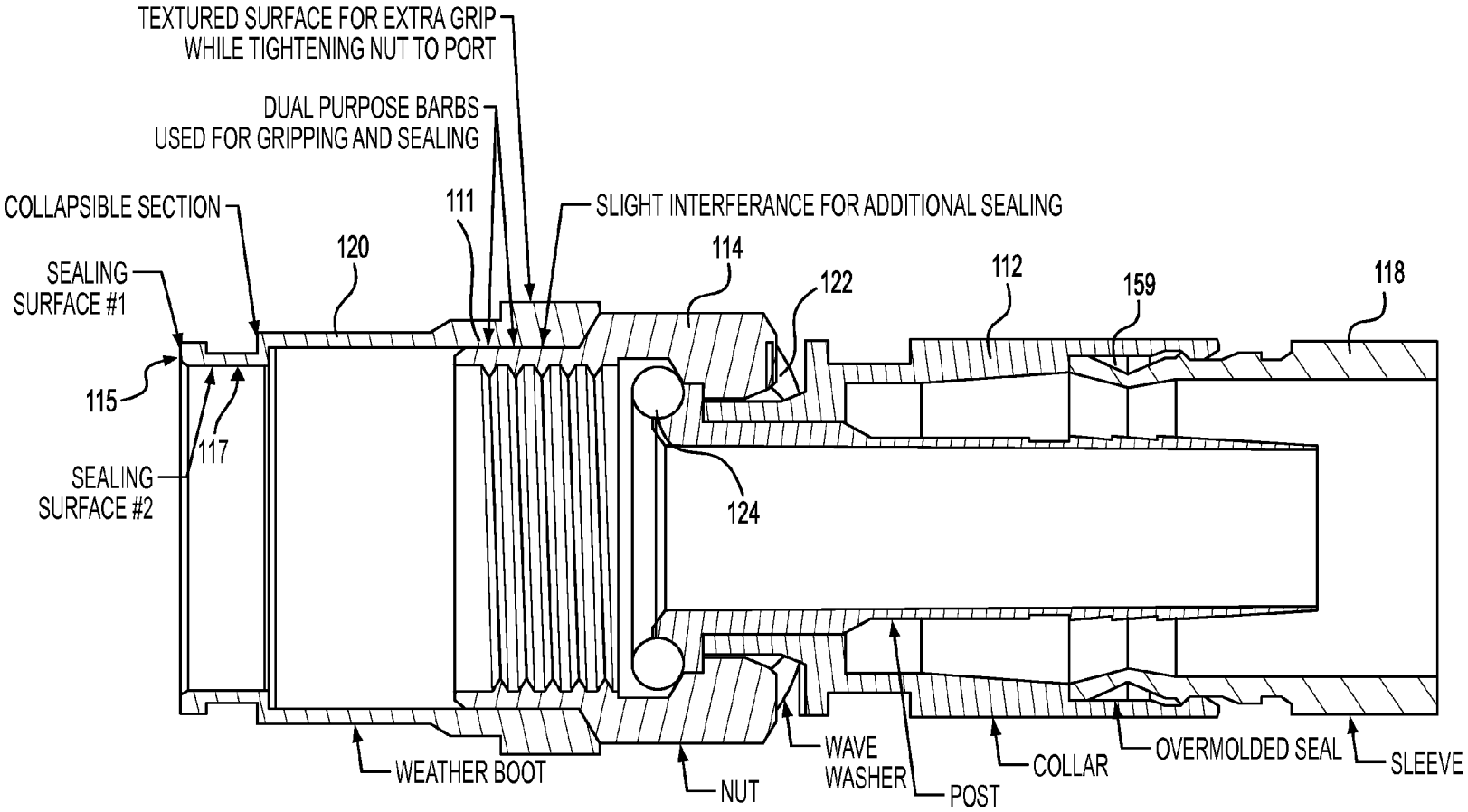

Referring now to FIGS. 12-14, a coaxial cable connector 110 is shown according to an exemplary embodiment. Connector 110 may share many features with connector 10, including having a connector body 112, a fastener 114, a sleeve 118, a compressible member 122, and a post 116. Connector 110 may further include a seal such as an o-ring 124 provided within an interior portion of fastener 114, and a seal 159 that surrounds sleeve 118.

According to an exemplary embodiment, connector 110 also includes a sealing assembly 120 that is configured to engage a port connector and provide a seal between connector 110 and the port connector when the connectors are mated. Sealing assembly 120 may be coupled to a forward portion of fastener 114, e.g., by way of one or more projections 111 (e.g., barbs, etc.) that extend from an outer surface of fastener 114 and are configured to retain sealing assembly 120 on connector 110 and provide an additional sealing feature for the connector. All or a portion of the exterior of seal 120 may have a textured area to provide additional gripping while tightening the fastener to a port connector. Upon connector 110 being mated with a port connector, a first sealing portion 115 may form a first seal with a first surface of a mating port connector (e.g., with a surface generally parallel to surface 115 shown in FIG. 14), and a second sealing portion 117 may be configured to "collapse" radially around the port connector to form a second seal. As such, seal assembly 120 is configured to prevent ingress of moisture, debris, etc. into connector 110 and/or the mating port connector.

Figure 19:
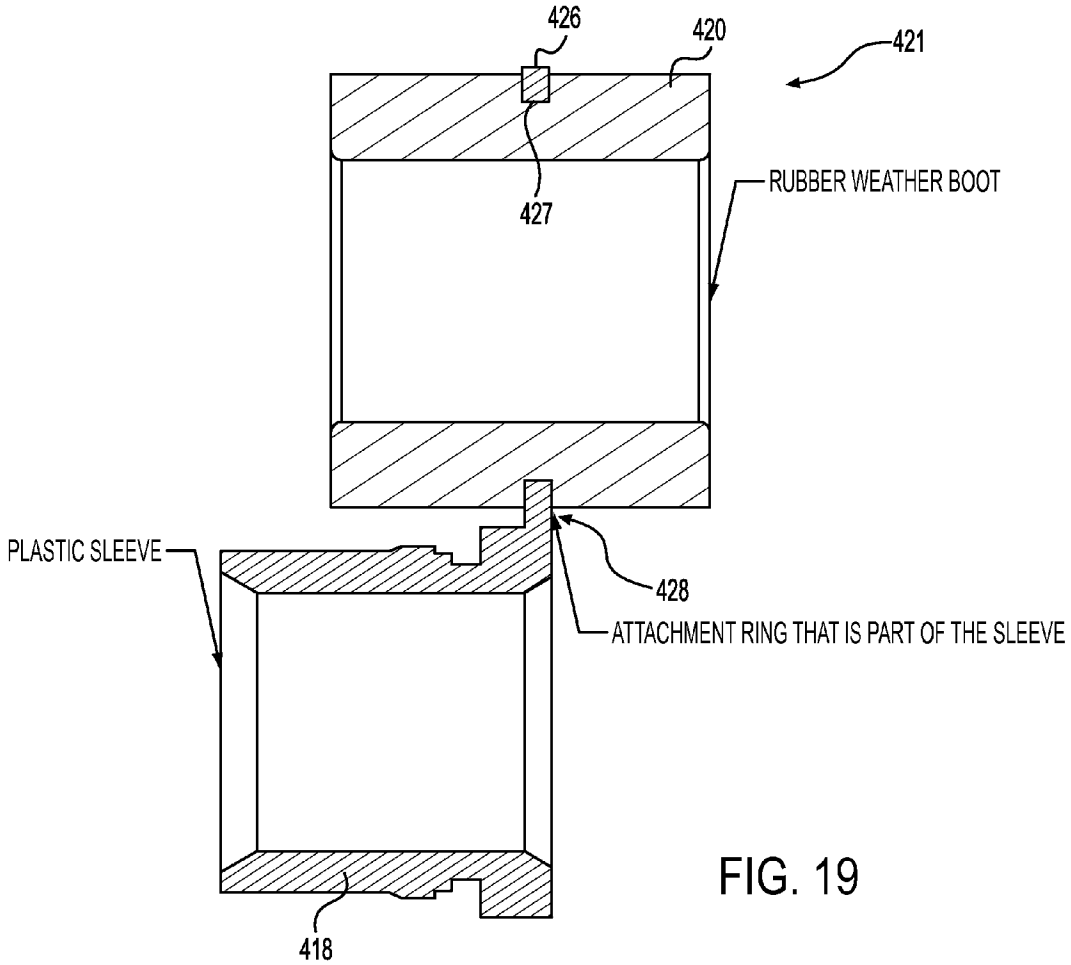

Referring to FIG. 19, a seal assembly 421 is shown according to an exemplary embodiment. Seal assembly 421 may be utilized in combination with any of the coaxial connectors illustrated herein. As shown in FIG. 19, seal assembly 421 is a generally frusto-conical member, and may take any of the shapes of interface seal 20 shown in FIGS. 1-6. However, interface seal 420 of seal assembly 421 is coupled to sleeve 418 in a different manner than that utilized in connection with interface seal 20.

According to an exemplary embodiment, a sleeve 418 is formed with a coupling ring 426 (e.g., an attachment ring or member, etc.). Ring 426 may integrally formed with the remainder of sleeve 418 and be of the same material. In other embodiments, ring 426 may be formed with a different process and/or material. Seal 420 is received within ring 426 via a recess 427. In order to remove seal 420, ring 426 and seal 420 may be twisted and/or pulled relative to sleeve 418 to rupture, tear, break, etc. a coupling portion 428 that joins ring 426 with the remainder of sleeve 418. Alternatively, seal 420 may be slid out from ring 426 (e.g., by slightly compressing seal 420) without breaking coupling portion 428. Similar to interface seal 20, seal 420 may then be attached to a port connector and used to seal a connection interface as discussed elsewhere herein.

Various embodiments disclosed herein further relate to a locking sleeve or related components that are usable to secure a coaxial cable within a coaxial cable connector. More specifically, a collapsible or deformable sleeve or similar component may be utilized such that upon fully inserting the sleeve into the connector body, at least a portion of the sleeve collapses or deforms toward the outer surface of the coaxial cable and/or a forward portion of the connector (e.g., at a forward tilt angle), thereby providing a compressive retention force for securing the cable within the connector, and providing a seal to prevent unwanted moisture or other materials from entering the interior of the coaxial cable connector.

Referring back to FIG. 1, according to one embodiment, connector body 12 is a generally cylindrical member having a first, or front end, a second, or rear end, an outer surface, an inner surface, and an inner bore extending through body 12. Body 12 may be made of a suitable metal (e.g., brass, etc.) or other material, including non-metals, and may be cast, molded, cold headed, or made using a different process. Body 12 further includes a shoulder portion 41 and a rear flange, or lip 43. In one embodiment, shoulder portion 41 acts as a stop to define a forward limit of axial movement of sleeve 18. While shoulder portion 41 is shown in FIGS. 1-6 as being defined by two wall portions of body 12, other configurations for shoulder portion 41 may be used according to various alternative embodiments. Lip 43 acts to retain at least a portion of sleeve 18 within body 12.

The inner and/or outer diameters of body 12 may vary along the length of body 12. For example, forward end of body 12 has a relatively smaller inner diameter to provide a proper fit (e.g., an interference fit, a snap fit, etc.) with post 16. Between the forward end and rearward end, body 12 may have a tapered inner diameter to provide a proper fit for receiving an exterior jacket, shield, or other components of a coaxial cable between body 12 and post 16. The rearward end of body 12 may have a relatively larger inner diameter to accommodate sleeve 18 and a coaxial cable.

According to an exemplary embodiment, sleeve 18 may be made from a deformable and/or collapsible material such as a plastic or another suitable material, and may be machined, injection molded, or made using a different process. In one embodiment sleeve 18 is made from acrylonitrile butadiene styrene (ABS), although other polymers and/or similar materials may be used according to various other embodiments. Sleeve 18 is configured to be moveable from a first position (e.g., a pre-assembly, or unassembled, position), where sleeve 18 may be separated, or detached, from body 12 to facilitate assembly of connector 10, to a second position (e.g., a post-assembly, or assembled, position), where sleeve 18 may be retained within body 12 in a more secure, or permanent, fashion. At least a portion of the outer surface of sleeve 18 may slidably engage the inner surface of body 12. Further, sleeve 18 and body 12 may be provided with corresponding interfacing features (e.g., indents/detents, projections/recesses, etc.) configured to maintain sleeve 18 in the first and/or second positions. For example, in one embodiment, a first detent 45 on sleeve 18 engages lip 43 on body 12 to detachably or separably retain sleeve 18 in the first position, and after movement of sleeve 18 from the first position to the second position, a second detent 47 on sleeve 18 engages lip 43 on body 12 to retain sleeve 18 in the second position. Sleeve 18 may further include one or more recesses to receive lip 143 to facilitate retention of sleeve 18. For example, a recess in sleeve 18 may receive lip 43 in the second position.

As shown in FIG. 1, detents 45 may be provided along a portion of the perimeter of sleeve 18. For example, in one embodiment, two detents 45 are provided at substantially opposite locations on sleeve 18, and each detent 45 extends for a predetermined length (e.g., 0.100 in., more or less than 0.100 in., etc.). Each detent 45 may include chamfered, or beveled surfaces to facilitate movement and/or removal/detachment/separation of sleeve 18 from body 12, while maintaining sleeve 18 retained at least partially within body 12 when desired. According to various alternative embodiments, the size, shape, and number of detents 45 may be varied. For example, detents 45 may be "higher" or "lower" relative to the outer surface of sleeve 18, more or fewer detents may be utilized (e.g., 1, 3, 4, etc.), detents 45 may be equally or unequally distributed about the perimeter of sleeve 18, and so on. Detent 47, while shown as a continuous annular member, may likewise include discrete portions about sleeve 18 and may similarly vary in size, shape, number, and location. All such variations are understood to be within the scope of the present disclosure.

It should be noted that while FIG. 1 shows a specific configuration of corresponding features (e.g., lip 43 and detents 45, 47) for retaining sleeve 18 in the first and/or second position, other features may be utilized (e.g., other recesses, projections, friction fits, snap fits, etc.), and the relative positions of the features may be reversed. For example, in some embodiments, the rearmost end of body 12 and a recess on sleeve 18 may define complementary angled surfaces (e.g., each provided at an angle of 30 degrees, 60 degrees, etc. from horizontal). All such features and combinations of features are within the scope of the present disclosure.

Referring further to FIG. 1, according to an exemplary embodiment, sleeve 18 includes a collapsible portion 51 (e.g. a thin-walled portion, a compressible portion, a deformable portion, etc.) having a first annular sidewall 53 and a second annular sidewall 55 coupled via an annular joint 57. According to an exemplary embodiment, first and second sidewalls 53, 55 are annular sidewalls configured to collapse, or deform, upon an axial force being applied to sleeve 18 and sleeve 18 being moved from the first position to the second position. Joint 57 may provide a relatively smooth transition between first and second sidewalls 53, 55, or alternatively, may include a notch, relief, or similar feature to facilitate proper collapsing and/or deformation of first and second sidewalls 53,55.

In some embodiments, first and second sidewalls 53, 55 are asymmetric about joint 57. In other words, first and second sidewalls 53, 55 may not be mirror images of each other about joint 57. For example, in some embodiments, second sidewall 55 may be relatively longer and/or thicker (e.g. in the radial direction) than first sidewall 53. Further, first and second sidewalls 53, 55 may form an asymmetric "V"-shape (e.g., a V-shape having unequal leg lengths, or having legs extending relative to a horizontal surface at differing angles). For example, in one embodiment, the portion of the inner surface of body 12 extending from shoulder 41 may define a generally cylindrical surface, and first and second sidewalls 53, 55 may form differing angles with the cylindrical surface. In some embodiments, first sidewall 53 may form approximately a 20 degree angle with the cylindrical surface, while second sidewall 55 may form approximately a 15 degree angle with the cylindrical surface. According to various other embodiments, first and second sidewalls 53, 55 may be positioned at differing relative angles (e.g., at angles more or less than 20 degrees and 15 degrees, respectively, etc.).

Figure 11:
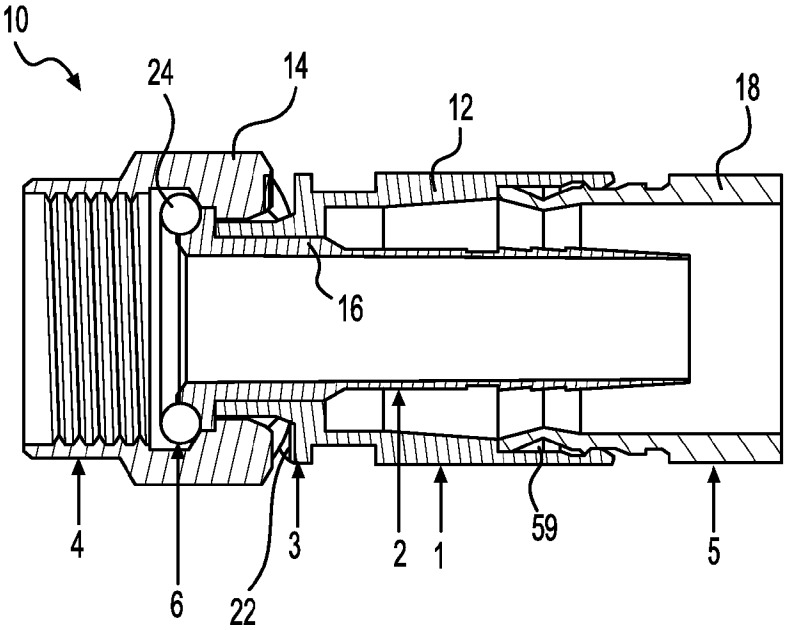
Figure 10:
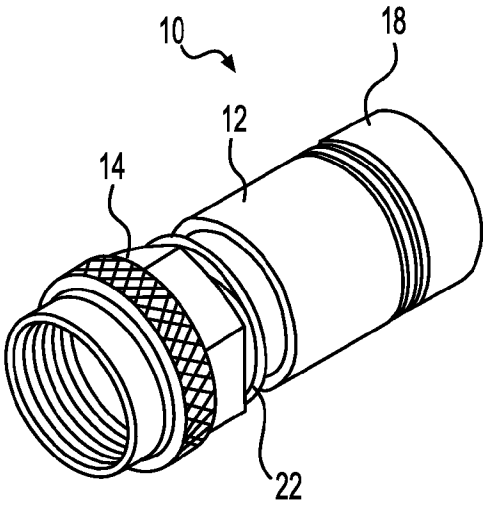

In some embodiments, the outer surfaces of first and second sidewalls 53, 55 form a first annular V-shape, and the inner surfaces of first and second sidewalls 53, 55 form a second annular V-shape, when sleeve 18 is in the first position. Joint 57 (e.g., the apex of the V-shape) may define the smallest inner diameter of sleeve 18 in the first position and/or the second position. This may provide for a relatively larger opening at the rear portion of sleeve 18 and facilitate guiding the cable into connector 10. In some embodiments, a space is defined by the outer surface of sleeve 18 and the inner surface of body 12, and a sealing member, such as o-ring or other seal 59 (see FIG. 11), is provided in the space so as to ensure that a sufficient seal (e.g., a moisture seal, etc.) is formed annularly between sleeve 18 and body 12. Alternatively, seal 59 may be omitted such that sleeve 18 may be coupled to body 12 without the use of o-rings or other seals. The V-shaped construction of first and second sidewalls 53, 55 may provide a more controlled and uniform collapse of collapsible portion 51 and reduce the axial compressive force required to move sleeve 18 from the first position to the second position.

Referring further to FIG. 1, connector 10 is shown in the first position configured to receive a coaxial cable. Sleeve 18 is positioned at least partially within body 12. A front portion of sleeve 18 is positioned adjacent shoulder 41 of body 12. Shoulder 41 acts as a stop to limit forward axial movement of sleeve 18. Shoulder 41 may be provided at any suitable location along the inner surface of body 12 to enable proper movement and retention of sleeve 18. When sleeve 18 is in the first position, the cable may be inserted through the rear portion of sleeve 18 such that the inner conductor and insulator of the cable are received within an inner bore of post 16, and the outer conductor and/or jacket of the cable are positioned between post 16 and body 12 and/or sleeve 18.

With the cable (not shown) properly seated within connector 10, sleeve 18 may be moved axially (e.g. linearly) to the second position. In some embodiments, a tool may be utilized to provide an axial compressive force sufficient to move sleeve 18 from the first position to the second position. As sleeve 18 moves from the first position to the second position, shoulder 41 on body 12 limits forward axial movement of sleeve 18, causing first and second sidewalls 53, 55 to "collapse," and move radially inward such that they form a grasping member (e.g., a barb, projection, etc.) in the second position. The grasping member may be sized and shaped such that the outer conductor and/or outer jacket of the cable are radially compressed between the grasping member and post 16. Further, the grasping member is configured such that in the second position, an appropriate seal (e.g., a moisture seal, etc.) is formed between the grasping member and the outer jacket of the cable (e.g., to ensure that unwanted moisture, particles, etc. do not enter the interior of connector 10).

According to an exemplary embodiment, first and second sidewalls 53, 55 form the grasping member such that the grasping member has a forward tilt. In other words, rather than the grasping member being directed radially straight inward (e.g., substantially perpendicular to a longitudinal axis of connector 10) the grasping member is formed such that it is directed in both a radially inward direction and a forward direction. Providing such a grasping member may increase the retention force of connector 10 relative to purely inward-directed grasping members or rearward-tilted retention members, and permit the use of lower profile barbs on post 16 to reduce the insertion forces required to assemble connector 10.

The coaxial cable connectors shown herein may provide various advantages over more conventional coaxial cable connectors. For example, because of the asymmetric collapsing features (e.g., providing a forward tilt to the collapsing portion), a "barb shaped" crimp is formed to "bite" into the cable and provide higher retention forces than more conventional connectors that may provide only a radially inward force. Such features may permit the use of fewer barbs, lower profile barbs, or even no barbs on the post. Using fewer, lower profile, or no barbs may reduce the insertion forces required to insert the cable into the connector (e.g., requiring a "cable-to-connector" insertion force of 20 pounds or less) and reduce tool compressive forces required to fully assemble the connector. Further, utilizing a plastic sleeve may be more cost-effective than using metal components, and a plastic sleeve utilizing a snap fit type interface with the connector body (e.g., for transit, etc.) may allow for greater part tolerances and further cost reductions. Furthermore the "space" formed between the collapsible portion and the body is sealed, preventing moisture and/or other unwanted materials from interfering with the operation of the connectors (e.g., in contrast to connectors which may have certain features exposed and more susceptible to interference from unwanted materials, moisture, etc.). Further yet, utilizing a snap fit between the sleeve and connector body is more cost effective relative to other fastening means such as press-fitting, threaded engagement, etc.

Additionally, other advantages may be provided, such as minimizing "blind entry" of the cable end into the post due to at least a portion of the sleeve being captured within the body even in the unassembled (e.g., first) position. The detachable feature of the sleeve may also facilitate assembly of the connector. Further, the sealing features of the connector may improve the electrical, mechanical, and environmental properties and provide for increased cable retention and minimized moisture migration.

Further embodiments discussed herein are configured to facilitate a solid physical and electrical connection between the fastener and the post by providing a force or pressure in the forward direction (e.g., toward an end of the connector configured to contact the port or other connector). In some embodiments, the force or pressure may be exerted on the fastener by a compressible member disposed on an outer surface of the body (e.g., between the body and the fastener). In some embodiments, connectors may continue to propagate and shield RF signals regardless of torque requirements (e.g., as recommended by the Society of Cable Telecommunications Engineers).

According to one embodiment, Fastener 14 is rotatably coupled to the forward end of connector body 12. Fastener 14 may include an inwardly extending shoulder or flange 31. The axial movement of fastener 14 in a forward direction relative to connector body 12 and post 16 is limited by the contact of flange 31 of fastener 14 with a flange 33 of post 16.

Fastener 14 may include various features to facilitate the rotation of fastener 14 relative to connector body 12. For instance, according to various exemplary embodiments, fastener 14 may comprise a hex nut, a wing nut, a nut with a knurled surface for finger-tightening, a nut with an overmold feature, or another suitable fastener. Fastener 14 is configured to provide an element or assembly for coupling connector 10 to the terminal of an electronic or other device or muting connector. According to an exemplary embodiment, fastener 14 includes a central bore or cavity with internal threads that engage the threads of a terminal of the device (e.g., a port) and/or another connector or coupling device.

According to an exemplary embodiment, a compressible member 22 (e.g., spring element, flexible element, compressible material, etc.) is provided to apply a force (e.g., a continuous pressure) in the forward direction to fastener 14 and maintain the contact between surface 35 and 37. The compressible member 22 may be compressed in a linear direction, axial direction, radial direction, etc. While being forced in a forward direction by the compressible member, fastener 14 is able to be rotated to couple connector 10 to the terminal of an electronic device. According to an exemplary embodiment, a force of at least approximately ½ in-lb. is applied to maintain the contact between surface 35 and 37.

According to an exemplary embodiment, the force exerted by the compressible member 22 on fastener 14 is sufficient to maintain contact between contact surfaces 35 and 37 not only if fastener 14 is fully tightened (i.e., tightened to a torque of 25-30 in/lb as recommended by the Society of Cable Telecommunication Engineers), but also through approximately 3 or 4 rotations of fastener 14 (e.g., sealing against egress). While the compressible member 22 is under compression (e.g., exerting an opposite and equal force against flange 31 of fastener 14 and flange 39 of body 12), signals continue to pass through a front surface plane of fastener 14. Electrical and RF signals may pass through fastener 14 during rotation of fastener 14. In some embodiments, there may beta slight (angular) center line misalignment of the male and female connectors (e.g., perpendicular to both reference planes) to prevent signal loss (e.g., ingress and egress). In some embodiments, the compressible member may apply a force that causes flange 31 of fastener 14 to contact flange 33 of post 16 with a gap or clearance between the flanges of less than 0.012 nominal inches. In some embodiments, at least a portion of the compressible member may be external to fastener 14 in one or both of an axial and a radial direction. The compressible member may be used with one or more modifications to the threads of fastener 14, as described above, to further improve the conductive coupling of post 16 and fastener 14.

According to one exemplary embodiment, the compressible member comprises a flexible washer or wave spring 22 provided between fastener 14 and connector body 12. A recess is formed between an outward-facing surface of connector body 12 (e.g., facing at least partially away from a center point of the connector, facing at least partially away from a longitudinal axis of the body and/or post, facing at least partially away from the body and/or post in an axial and/or radial direction, etc.), the rearward end of fastener 14 and a flange or forward-facing surface 39 of connector body 12. Wave spring 22 is compressed between the rearward end of fastener 14 and flange 39 of connector body 12, applying a force in the forward direction to fastener 14 away from connector body 12 and against post 16. In some embodiments, wave spring 22 may be configured to apply a substantially continuous pressure to fastener 14, urging fastener 14 into substantially continuous physical and electrical contact with post 16. In other embodiments, wave spring 22 may instead be another suitable spring device such as a helical coil spring, a conical spring, etc.

Figure 15:
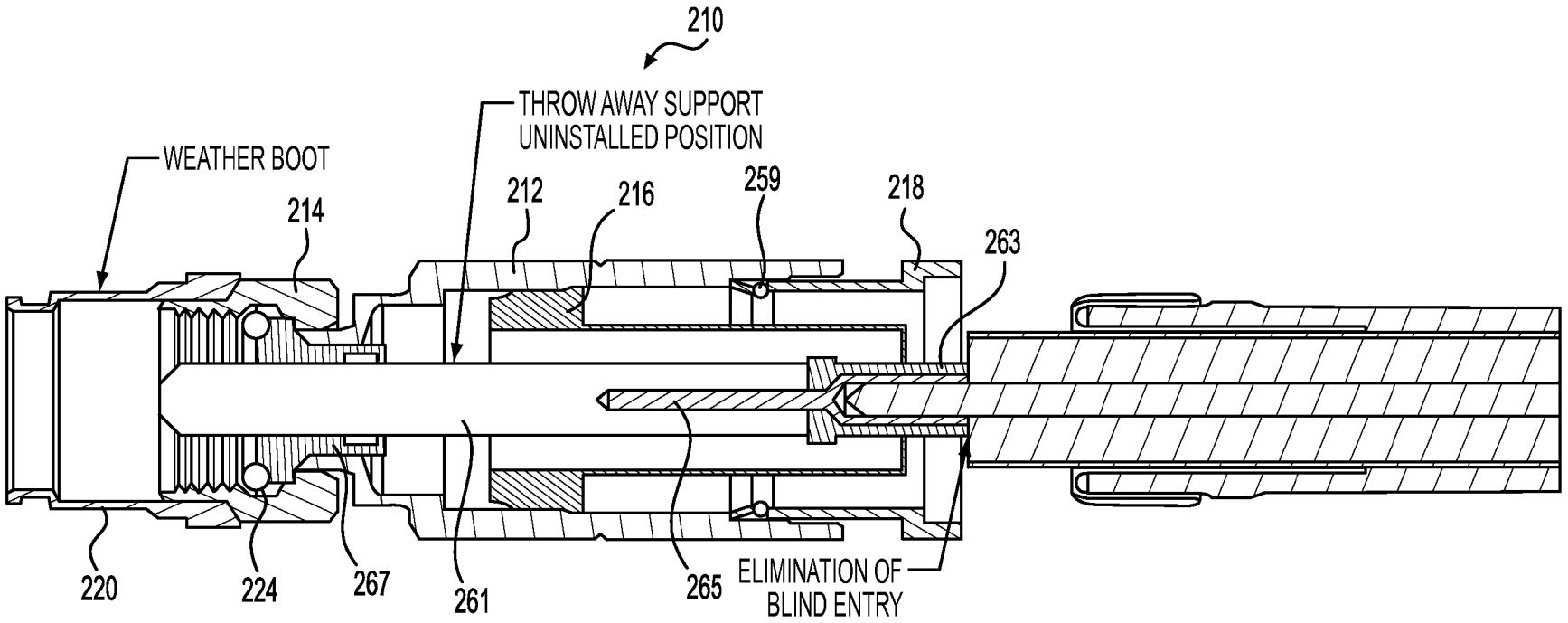
Figure 16:
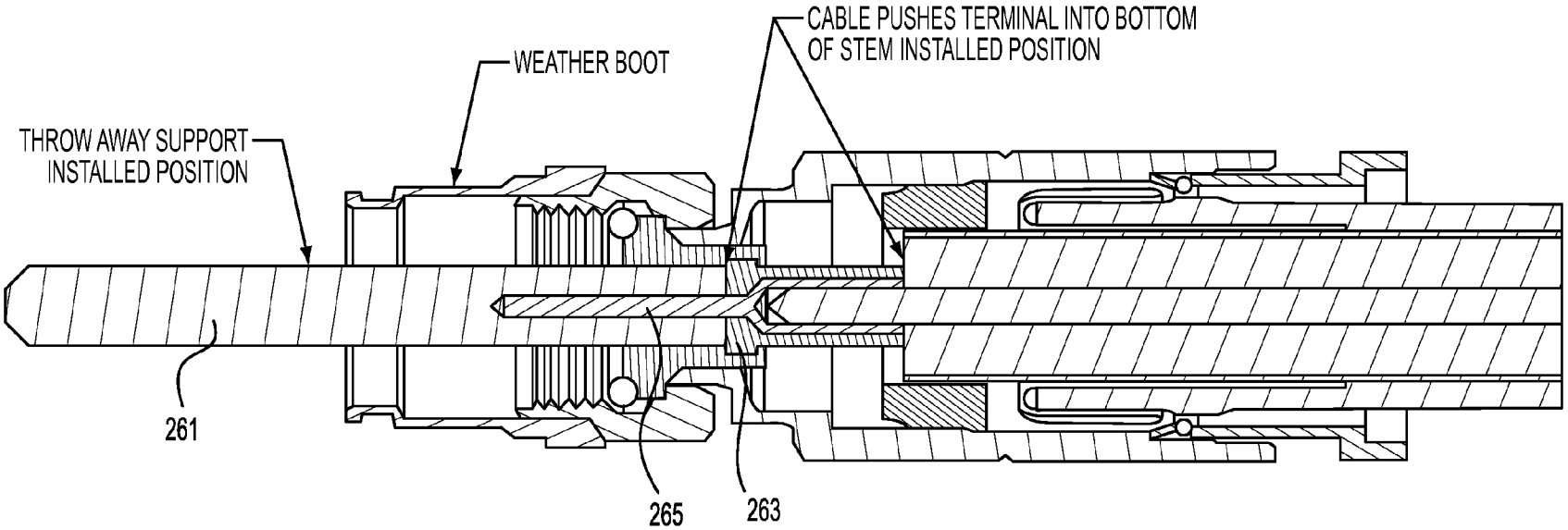

Referring to FIGS. 15-16, a coaxial cable connector 210 is shown according to an exemplary embodiment. Connector 210 may share many of the features of connector 10 and 110 disclosed elsewhere herein. For example, connector 210 includes a connector body 212, a fastener 214, a post 216, a sleeve 218, and seals 224 and 259.

In one embodiment, connector 210 further includes a guide 261 (e.g., an installation guide, a starter guide, etc.) configured to facilitate insertion of a coaxial cable center conductor into and through the connector. As shown in FIGS. 15-16, a center conductor of a coaxial cable may be received in an extension pin 265, having a bore therein sized to receive the center conductor. A socket 263 (e.g., a first insulator, etc.) surrounds at least a portion of extension pin 265, and a rearward portion of socket 263 engages the dielectric portion of the cable. As shown in FIG. 15, prior to receiving the coaxial cable, socket 263 may project rearward from the end of sleeve 218 so as to eliminate any "blind entry" problems often associated with coaxial cables.

Referring further to FIGS. 15-16, the rearward portion of guide 261 receives the forward portion of extension 265, and the forward portion of guide 261 is received by a bushing 267 (e.g., a second insulator, etc.). Bushing 267 is provided within at least a portion of body 212. Bushing 267 includes an inner bore sized to correspond to the outer diameter of guide 261 such that bushing 267 maintains guide 261 generally aligned with the longitudinal axis of connector 210.

To install a cable into connector 210, a user first inserts the center conductor into extension 265 (see FIG. 15). The cable is then pushed further into the connector until socket 263 engages bushing 267 (see FIG. 16). Upon socket 263 being seated in bushing 267, guide 261 may then be removed from connector 210 by pulling guide 261 out from the forward end of fastener 214 and seal 220. According to an exemplary embodiment, the rearward portion of bushing 267 includes a recess (e.g., a counterbore, etc.) sized to receive the forward portion of socket 263 and limit the forward travel of socket 263, extension 265, and therefore, the coaxial cable. After fully seating the coaxial cable, sleeve 218 may then be moved longitudinally forward within connector body 212 to securely terminate the connector onto the cable.

Figure 17:
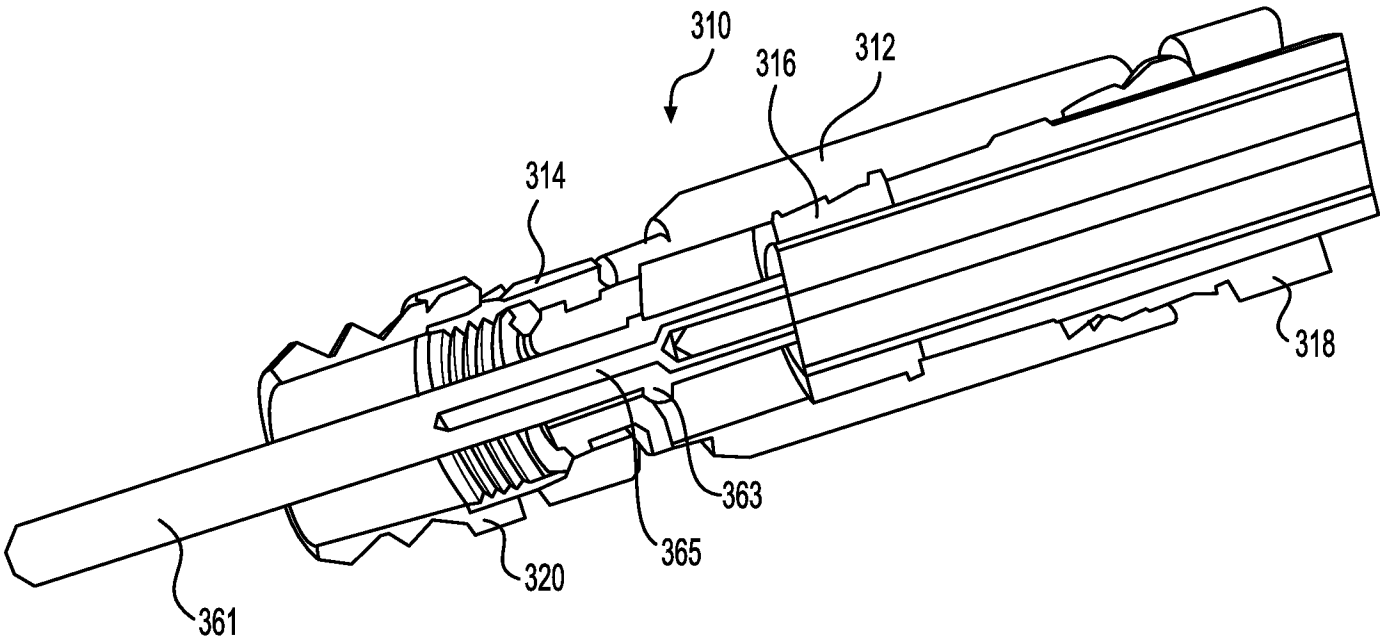
Figure 18:
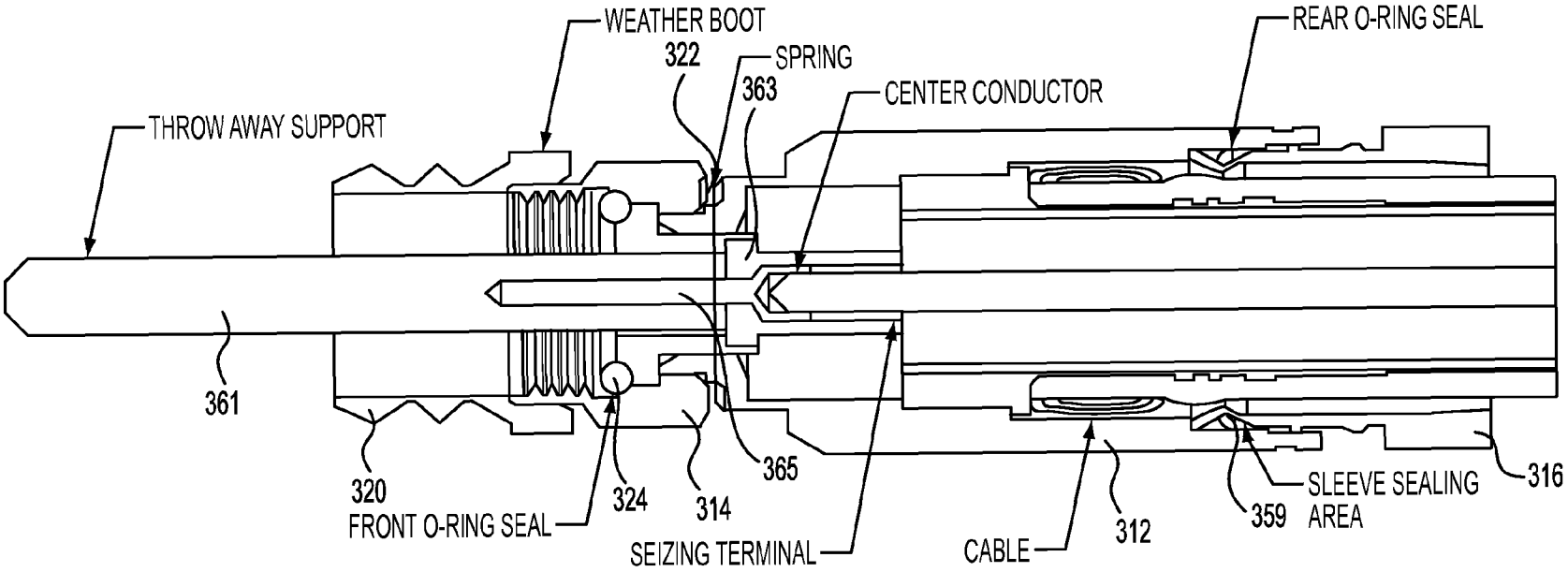
FIGS. 18-21 illustrate seal assemblies usable with coaxial cable connectors according to various embodiments.

Referring to FIGS. 17-18, a coaxial cable connector 310 is shown according to an exemplary embodiment. Connector 310 may share many features with connector 210, including a connector body 312, a fastener 314, a post 316, a sleeve 318, extension 365, socket 363, and guide 361. Furthermore, connector 310 may include a compressible member 322 that acts in a similar manner to compressible member 22 discussed with respect to FIGS. 1-6.

In one embodiment, connector 310 further includes a seal 320, which is configured to provide similar sealing to seals 20, 120, and 220, but which has a slightly different construction. As shown in FIGS. 17-18, the rearward portion of seal 320 is configured to be coupled to fastener 314. The forward portion of seal 320 is configured to engage a mating port connector, and may collapse, or deform, radially inward and longitudinally when compressed between fastener 314 and a mating port connector. As such, seal 320 may maintain a seal between connector 310 and mating port connectors of variable length by way of the compressibility of the seal in the longitudinal direction.

Referring to FIGS. 25A-D, a guide 461 is shown according to an exemplary embodiment. Guide 461 is generally usable in a similar manner to guides 261, 361. Guide 461 includes a front portion 463, a rear portion 465, and an intermediate portion 467 that couples front portion 463 to rear portion 465. Forward portion 463 may have a frusto-conical tip portion configured to facilitate insertion of guide 461 into a connector. In other embodiments, the tip of forward portion 463 may be conical, rounded, cylindrical, or take any other suitable form. Rear portion 465 includes a recess, or bore, to receive the center conductor of a coaxial cable.

Figure 25A:
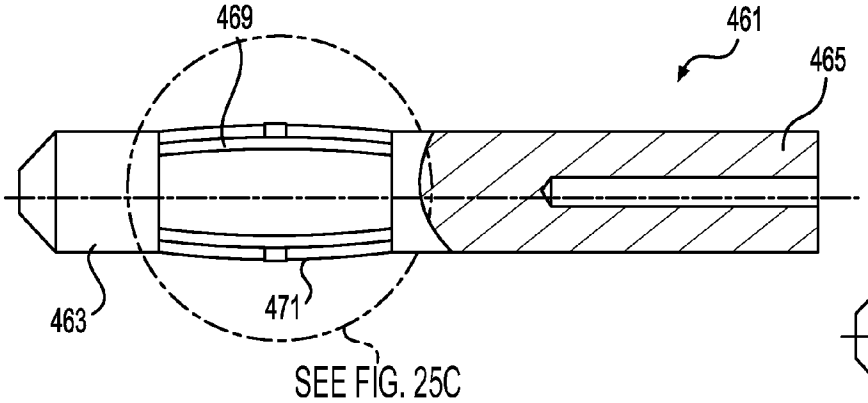
FIGS. 25A-D illustrate a guide pin according to another exemplary embodiment.
Figure 25B:
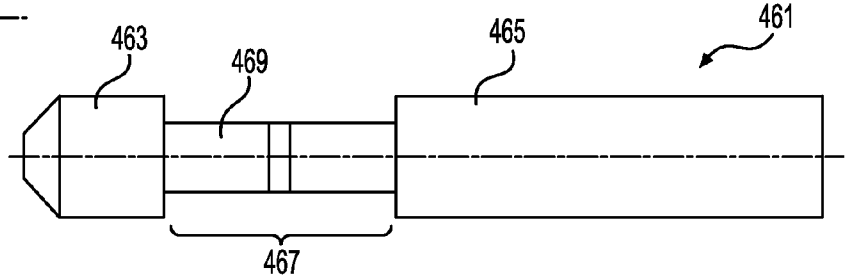
Figure 25C:
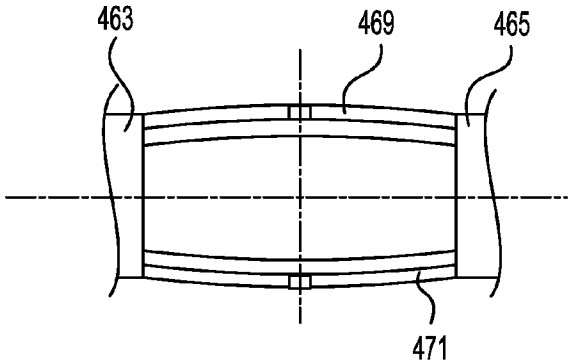
Figure 25D:
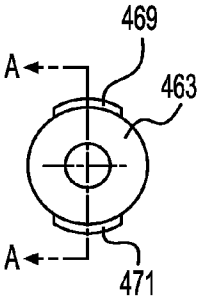

Intermediate portion 467 is a compliant member, section, or portion configured to provide a radially outward force to assist in maintaining guide 461 within a connector. Intermediate portion 467 includes first and second arms 469, 471 (e.g., elongated members, spring members, compliant members, etc.) that extend between forward portion 463 and rearward portion 465. As shown in FIGS. 25A and 25D, arms 469, 471 are outwardly deflected at their respective midsections (e.g., at a joint, hinge portion, etc., to provide radial resiliency) and are positioned on generally opposing circumferential sides of guide 461. According to various alternative embodiments, more or fewer arms may be utilized, and arms 469, 471 may take any suitable shapes and be positioned at any suitable locations about the circumference of guide 461.

According to one embodiment, arms 469, 471 have a generally arcuate cross-section generally corresponding to the circumference of front and rear portions 463, 465. Arms 469, 471 are generally elongated members and may be made of a suitable plastic, composite, or other suitable material. In one embodiment, forward portion 463, rear portion 465, and intermediate portion 467 are integrally formed using, e.g., an injection process.

Referring back to FIG. 1, in some embodiments, a seal such as o-ring 24 may be provided within the interior of fastener 14. For example, as shown in FIG. 1, fastener 14 may be a nut having an at least partially threaded interior surface, and o-ring 24 may be provided within the interior of the nut adjacent the forward end of the post. In some embodiments, the interior surface of the nut may form an annular recess in which o-ring 24 may reside.

In some embodiments, o-ring 24 is made of an elastomeric material and is configured to compressibly engage the face of a mating port connector, such that O-ring 24 maintains engagement with the mating dace of the port connector even if fastener 14 should become loosened. As such, o-ring 24 forms a seal preventing the ingress of moisture, debris, and/or other undesirable materials into connector 10. Furthermore, in some embodiments, o-ring 24 may be a conductive o-ring such that an electrical pathway is maintained from the interface port to one or both of fastener 14 and post 16, even should fastener 14 become loosened relative to a fully tightened position.

Figure 22:
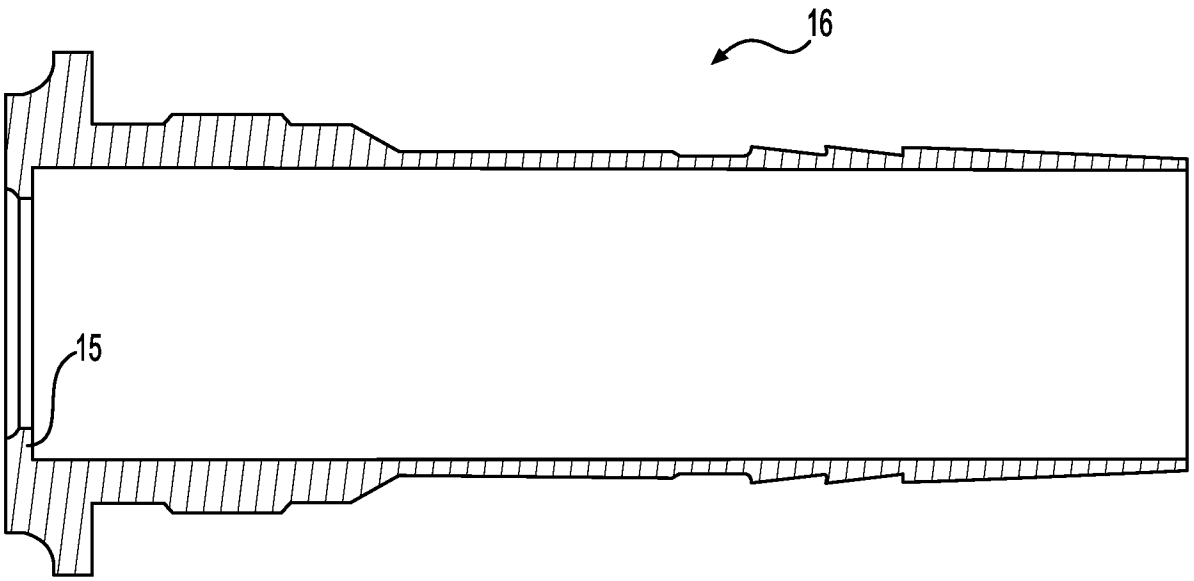
FIG. 22 is a cross-sectional view of a post according to an exemplary embodiment.

Referring to FIG. 22, in some embodiments, post 16 may include an inwardly-directed flange 15 (e.g., a lip, inwardly-extending portion or member, etc.). Flange 15 is configured to act as a cable stop by engaging the dielectric portion of a coaxial cable and preventing an installer from inserting a coaxial cable into a connector such that the cable extends forward of the front face of the post. Flange 15 is a generally circular flange and may have any suitable width (e.g., in a radial direction) and thickness (e.g., along the longitudinal axis of the post). Flange 15 may be usable with any of the embodiments disclosed herein according to various exemplary embodiments.

It is important to note that the construction and arrangement of the elements of the various coaxial cable connectors and coaxial cable connector components as shown in the exemplary embodiments are illustrative only. Although a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the various embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

The following is claimed:

1. A connector comprising:

a connector body having a forward end and a rearward end, the rearward end configured to receive a coaxial cable;

a sleeve configured to be received at least partially within the connector body; and a seal assembly, the seal assembly comprising:

an interface seal having a first end and a second end, the interface seal configured to be removeably coupled to an interface port; and a sleeve seal configured to remain fixed to the sleeve when the interface seal is removed from the sleeve.

2. The connector of claim 1, further comprising a coupling member configured to detachably couple the interface seal to the sleeve seal.

3. The connector of claim 2, wherein the coupling member comprises a weakened area configured to tear upon a user applying a force and/or torque to the interface seal to detach the interface seal from the sleeve seal.

4. The connector of claim 1, further comprising a fastener coupled to the forward end of the connector body and configured to couple to the interface port, wherein the interface port and the fastener are configured to engage opposite ends of the interface seal when the fastener is coupled to the interface port.

5. The connector of claim 1, wherein the interface seal comprises a substantially constant inner diameter from the first end to the second end of the interface seal.

6. The connector of claim 1, wherein an outer surface of the interface seal defines a frusto-conical shape.

7. The connector of claim 1, wherein the sleeve seal comprises an inner annular seal coupled to an outer annular seal via at least one connecting member.

8. The connector of claim 7, wherein the inner annular seal is configured to form a moisture seal between the sleeve and the coaxial cable and wherein the outer annular seal is configured to form a moisture seal between the sleeve and the connector body.

9. The connector of claim 1, wherein the sleeve comprises an attachment ring defining an aperture, and wherein the seal assembly is received within the aperture of the attachment ring.

10. The connector of claim 9, wherein the attachment ring is an integrally molded portion of the sleeve.

11. The connector of claim 9, wherein the sleeve comprises a sleeve body, the attachment ring being detachable from the sleeve body at a weakened portion provided between the attachment ring and the sleeve body.

12. The connector of claim 1, wherein the seal assembly is removeably and slidably received on a rearward portion of the sleeve.

13. A connector comprising:

a connector body having a forward end and a rearward end, the rearward end configured to receive a coaxial cable;

a sleeve configured to be received at least partially within the connector body, the sleeve including a collapsible portion configured to form a forward-tilting barb, the forward-tilting barb configured to engage the connector when the sleeve is moved forward relative to the connector body;

a fastener coupled to the forward end of the connector body and configured to fasten to a mating connector;

a post disposed at least partially within the connector body;

an annular seal configured to engage the mating connector; and a compressible member disposed at least partially between the connector body and the fastener, the compressible member configured to provide a biasing force against the connector body and fastener.

14. The connector of claim 13, wherein the fastener comprises a nut, wherein the nut comprises a first knurled portion and a second portion configured to receive a tool to tighten the fastener relative to the mating connector.

15. The connector of claim 13, further comprising an annular seal disposed about at least a portion of the collapsible portion of the sleeve.

16. The connector of claim 13, wherein the compressible member comprises an annular wave washer configured to act between a rearward portion of the fastener and the connector body.

17. The connector of claim 13, further comprising a seal assembly detachably coupled to the sleeve.

18. The connector of claim 13, further comprising:

a center pin extension configured to receive a center conductor of the coaxial cable; and a center pin guide configured to slidably guide the center pin extension within the connector body as the coaxial cable is received within the connector body, the center pin guide comprising an intermediate compliant portion configured to provide a retention force to removeably retain the center pin guide within the connector body.

19. A cable connector comprising:

a body having a forward end and a rearward end, the rearward end configured to receive a cable;

a sleeve configured to be received at least partially within the body; and a seal member, at least a portion of the seal member removeably coupled to the sleeve and configured to provide a seal at one end of the body, and a portion of the seal member configured to remain fixed to the sleeve.

20. The cable connector of claim 19, wherein the portion of the seal member removeably coupled to the sleeve comprises an interface seal, the interface seal configured to be coupled to a port.

21. The cable connector of claim 20, wherein the portion of the seal member configured to remain fixed to the sleeve comprises a sleeve seal.

22. The cable connector of claim 21, wherein the interface seal and the sleeve seal comprise a seal assembly.

23. The cable connector of claim 21, further comprising a coupling member configured to detachably couple the interface seal to the sleeve seal.

24. The cable connector of claim 23, wherein the coupling member comprises a weakened area configured to tear upon a user applying a force and/or torque to the interface seal to detach the interface seal from the sleeve seal.

25. The connector of claim 20, further comprising a fastener coupled to the forward end of the body and configured to couple to the port.

26. The cable connector of claim 25, wherein the interface seal comprises a first end configured to engage the port and a second end configured to engage the fastener when the fastener is coupled to the port.

27. The cable connector of claim 21, wherein the sleeve seal comprises an inner annular seal coupled to an outer annular seal via at least one connecting member.

28. The cable connector of claim 27, wherein the inner annular seal is configured to form a moisture seal between the sleeve and the cable, and wherein the outer annular seal is configured to form a moisture seal between the sleeve and the body.

29. The cable connector of claim 19, wherein the sleeve comprises an attachment ring defining an aperture, and wherein the seal member is received within the aperture of the attachment ring.

30. The cable connector of claim 29, wherein the attachment ring is an integrally molded portion of the sleeve.

31. The cable connector of claim 29, wherein the sleeve comprises a sleeve body, the attachment ring being detachable from the sleeve body at a weakened portion provided between the attachment ring and the sleeve body.

32. The cable connector of claim 19, wherein at least a portion of the seal member is removeably and slidably received on a rearward portion of the sleeve.

* * * * *